US011092407B2

(12) United States Patent
Bernkrant et al.

(10) Patent No.: US 11,092,407 B2
(45) Date of Patent: Aug. 17, 2021

(54) SECURABLE CONTAINER

(71) Applicants: Keith Bernkrant, Cape Canaveral, FL (US); Paul Richter, Titusville, FL (US)

(72) Inventors: Keith Bernkrant, Cape Canaveral, FL (US); Paul Richter, Titusville, FL (US)

( * ) Notice: Subject to any disclaimer, the term of this patent is extended or adjusted under 35 U.S.C. 154(b) by 306 days.

(21) Appl. No.: 15/681,385

(22) Filed: Aug. 19, 2017

(65) Prior Publication Data

US 2018/0010884 A1 Jan. 11, 2018

Related U.S. Application Data

(63) Continuation-in-part of application No. 15/544,738, filed on Jul. 19, 2017, now Pat. No. 10,494,856, and a continuation-in-part of application No. PCT/US2017/018554, filed on Feb. 19, 2017, which is a continuation-in-part of application No. PCT/US2016/018813, filed on Feb. 19, 2016, and a continuation of application No.
(Continued)

(51) Int. Cl.

| | |
|---|---|
| ***F41C 33/02*** | (2006.01) |
| ***F41C 33/06*** | (2006.01) |
| *F42B 39/00* | (2006.01) |

(52) U.S. Cl.
CPC ..... *F41C 33/029* (2013.01); *F41C 33/0263* (2013.01); *F41C 33/0272* (2013.01); *F41C 33/06* (2013.01); *F42B 39/00* (2013.01)

(58) Field of Classification Search
CPC ..... F41C 33/029; F41C 33/0263; F41C 33/0272; F41C 33/06; F42B 39/00
See application file for complete search history.

(56) References Cited

U.S. PATENT DOCUMENTS 3,718,240 A * 2/1973 Rose ..... F41C 33/0209 224/243
5,111,755 A * 5/1992 Rouse ..... A47B 81/005 109/25

(Continued)

OTHER PUBLICATIONS

PCT International Search Report dated Jun. 9, 2016.

(Continued)

*Primary Examiner* — Derek J Battisti
(74) *Attorney, Agent, or Firm* — Lowndes; Stephen C. Thomas

(57) ABSTRACT

A container for a firearm or other valuable, which may be worn on a belt, comprising and enclosure having an interior volume and containing an opening in a surface thereof, a retractable cover for covering the opening when the retractable cover is in a non-retracted position, a firearm retaining mechanism disposed within the interior volume; a firearm extending mechanism disposed within the interior volume; and a releasable latch for maintaining the firearm extending mechanism in a retracted position. A user may manually retract the cover causing a firearm contained within the interior volume to be extended for easy access. Geolocation, status and other information may be communicated to a remote user through a wireless data link. A camera may be activated by retracting the cover were upon video data may be transmitted to a remote monitor. The container may be remotely locked or unlocked. The container may be a holster.

14 Claims, 18 Drawing Sheets

CLOSED - GUN LOCKED DOWN

Related U.S. Application Data

PCT/US2016/018813, filed as application No. PCT/US2015/051285 on Sep. 21, 2015, and a continuation-in-part of application No. PCT/US2015/051285, filed on Sep. 21, 2015.

(60) Provisional application No. 62/274,367, filed on Jan. 3, 2016, provisional application No. 62/119,099, filed on Feb. 20, 2015, provisional application No. 62/105,201, filed on Jan. 19, 2015.

(56) References Cited

U.S. PATENT DOCUMENTS 5,416,472 A * 5/1995 Torii, Jr. ..... A47B 81/005 211/64
5,416,826 A 5/1995 Butler
5,828,301 A 10/1998 Sanchez
5,884,799 A * 3/1999 Korber ..... B60R 7/04 220/345.3
6,276,735 B1 8/2001 Champion
6,523,374 B1 2/2003 Owens
6,570,501 B2 * 5/2003 Bushnell ..... E05B 47/0002 206/1.5
6,588,635 B2 7/2003 Vor Keller et al.
6,829,917 B2 * 12/2004 Russell ..... F41A 23/02 206/1.5
6,918,519 B2 7/2005 Vor Keller et al.
7,200,965 B2 4/2007 Vor Keller et al.
8,186,188 B1 5/2012 Brown
8,579,348 B1 * 11/2013 Myers ..... B60R 7/04 296/24.34
9,459,074 B2 * 10/2016 Heim ..... E05G 1/005
9,666,056 B2 5/2017 Herrera et al.
9,743,277 B2 8/2017 Lin et al.
9,841,255 B2 12/2017 Koskan et al.
9,910,515 B2 3/2018 Richards et al.
9,939,545 B2 4/2018 Herrera et al.
2001/0033228 A1 10/2001 Kisreman et al.
2003/0057122 A1 3/2003 Bushnell
2004/0066275 A1 * 4/2004 Mickler ..... F41C 33/06 340/5.33
2014/0083338 A1 * 3/2014 McAlexander ..... E05G 1/02 109/52
2014/0162584 A1 6/2014 Cope
2014/0245934 A1 * 9/2014 Delattre ..... E05G 1/005 109/38
2015/0254968 A1 * 9/2015 Sanders ..... F41C 33/029 340/539.13
2016/0054080 A1 2/2016 Haimi
2016/0116253 A1 4/2016 Moon
2016/0173832 A1 * 6/2016 Stewart ..... F41A 17/20 348/158

OTHER PUBLICATIONS

PCT International Preliminary Report on Patentability dated Aug. 22, 2017.
PCT Search History Apr. 12, 2016.
China National Intellectual Property Administration First Office Action in CN application No. 201680022846.2, including English translation; dated Dec. 4, 2018.

* cited by examiner

CLOSED - GUN LOCKED DOWN

OPEN - GUN NOT LOCKED DOWN
(ACTION ABOUT TO HAPPEN)

(REAR MAIN BODY AND DOOR HIDDEN)

Remote Unlock Flowchart

SECURABLE CONTAINER

CROSS REFERENCE TO RELATED APPLICATIONS AND INCORPORATION BY REFERENCE

This non-provisional U.S. patent application under 35 U.S.C. 111(a) is a continuation of international application PCT/US16/18813 which was filed in the United States Receiving Office (USRO) of the United States Patent and Trademark Office (USPTO) under the Patent Cooperation Treaty (PCT) on Feb. 19, 2016, titled SECURABLE CONTAINER, which is herein incorporated by reference in its entirety which was a non-provisional of U.S. provisional patent application Ser. No. 62/119,099, titled PORTABLE SAFE filed in the USPTO on Feb. 20, 2015 which is also herein incorporated by reference in its entirety, and was also a non-provisional of U.S. provisional patent application Ser. No. 62/274,367 titled SECURABLE CONTAINER filed in the USPTO on Jan. 3, 2016 which is also herein incorporated by reference in its entirety and a continuation in part of PCT application International Application Number PCT/US15/51285 titled PORTABLE SAFE, filed in the USRO on Sep. 21, 2015 which is herein incorporated by reference in its entirety and which was a non-provisional of U.S. provisional application 62/119,099 titled PORTABLE SAFE filed in the USPTO on Feb. 20, 2015 which is also incorporated herein by reference in its entirety and was also a non-provisional of U.S. provisional application 62/105,201 titled CONCEALED CARRY CONTAINER filed in the USPTO on Jan. 19, 2015 which is also incorporated herein by reference in its entirety; this application is also a continuation in part of international application PCT/US17/18554 titled SMART WEAPON HOLSTER filed in the USPTO on Feb. 19, 2017, which is hereby incorporated by reference in its entirety and which was a continuation in part of international application Number PCT/US16/18813 titled SECURABLE CONTAINER filed in the USRO on Feb. 19, 2016, which is incorporated herein by reference in its entirety, which was a continuation in part of PCT/US15/51285 titled PORTABLE SAFE, filed in the USRO on Sep. 21, 2015 which is incorporated herein by reference in its entirety, and was a non-provisional of U.S. Provisional Application Ser. No. 62/119,099 titled PORTABLE SAFE, filed in the USPTO on Feb. 20, 2015 which is incorporated herein by reference in its entirety, and was a non-provisional of U.S. Provisional Application Ser. No. 62/274,367 titled SECURABLE CONTAINER, filed in the USPTO on Jan. 19, 2015, which is incorporated herein by reference in its entirety, PCT/US15/51285 was a non-provisional of U.S. Provisional Application Ser. No. 62/119,099 titled PORTABLE SAFE, filed in the USPTO on Feb. 20, 2015 which is incorporated herein by reference in its entirety, and was a non-provisional of U.S. Provisional Application Ser. No. 62/105,201 titled PORTABLE SAFE, filed in the USPTO on Jan. 3, 2016, which is incorporated herein by reference in its entirety; this application is also a continuation of U.S. non-provisional application Ser. No. 15/544,738 titled PORTABLE SAFE filed in the USPTO on Jul. 19, 2017, which hereby incorporated by reference in its entirety which is a 371 national stage application of international application PCT/US15/51285 titled PORTABLE SAFE, filed in the USRO on Sep. 21, 2015 which is incorporated herein by reference in its entirety and which was a non-provisional of U.S. provisional patent application Ser. No. 62/105,201 titled CONCEALED CARRY CONTAINER, filed in the United States Patent and Trademark Office (USPTO) on 19 Jan. 2015, which is hereby incorporated in its entirety by reference, and was a non-provisional of U.S. provisional patent application Ser. No. 62/119,099 titled PORTABLE SAFE, filed in the United States Patent and Trademark Office (USPTO) on 20 Feb. 2015, which is also hereby incorporated in its entirety by reference.

Any patent, patent application, or document referenced in this application is hereby incorporated by reference in its entirety.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

TECHNICAL FIELD

The invention relates generally to the field of containers in which valuables such as weapons such as for example firearms, jewelry, money, personal identification information or other valuable items may be stored and hidden from view. The field of the invention also includes containers that may be remotely accessible for the purpose of remotely unlocking or locking the container, reporting the condition or status of the container, and reporting container geolocation information. More specifically, a preferred embodiment and best mode of the invention is directed to a container, such as a holster, for a handgun, conducted electrical weapon or other firearm or weapon. In an embodiment the invention conceals a firearm in a securable portable container, where it may be safely carried and contained in a lockable container but which in which the firearm is readily accessible to aid in personal defense or in any tactical situation. The container of the invention may be used to carry any object desired by the user.

While a preferred embodiment and best mode of the container of the invention is an embodiment resembling a holster, such as a holster for firearm that may be worn by a person, for example on a belt, the container of the invention may take any physical form or shape and is not to be construed as being limited to only a holster that is wearable by a person. For example, the container of the invention may be utilized for carrying valuables or a firearm and a vehicle, motorhome, boat, home, or in virtually any environment in which a user may wish to carry such items in a secure and controlled manner.

BACKGROUND ART

It is often desirable that valuable items such as, for example, firearms, jewelry, money, credit cards, personal identification information, prescription medications, and other valuable items be securely carried on or with a person without revealing that the user is carrying such items. Some valuable items such as firearms must be concealed from view in public, in certain jurisdictions, due to laws or ordinances that require concealment. Furthermore, it is often desirable that the condition, status, or location of the valuable item be ascertainable by a remote monitor, or that the container in which it is carried the remotely lockable.

Various holsters have been developed that may hold a firearm in various locations on a person's body, for example inside the waistband of the wearer's pants or on or near the wearer's chest, such as a shoulder harness worn under the user's clothing. These apparatuses and methods for carry of firearms or other weapons are generally subject to certain drawbacks. For instance, inside-the-waistband holsters may be uncomfortable, may require unfashionable clothing or, if the user's clothing is too tight, may show, or "print", the outline of the firearm and thereby alert others in the vicinity that the user is carrying a concealed weapon. An additional drawback of inside-the-waistband holsters is that they may impede the drawing the firearm in an emergency if they shift during wearing or if the user's pants are constricted. Alternatively, shoulder harnesses may be worn for carry of a firearm, but these must generally be worn under the user's shirt or outer garment. If worn under the outer garment, which may be for example a coat, the user is prevented from removing the outer garment because the firearm may be revealed. If worn under an inner garment such as a shirt, the drawing the firearm may be impeded due to the fact that the firearm is beneath the wearer's shirt. Another drawback of the concealed carry holsters of the prior art is that they may not be lockable so as to prevent unauthorized access to a firearm or valuable object(s) stored in them. And, in any event, the holsters of the prior art are not remotely lockable, nor do they provide status of the firearm being carried, nor do they provide geolocation information to a remote user such as a monitor. However, such features are desirable for any number of situations, such as, for example and not by way of limitation, in law enforcement use.

What is needed in the art, therefore, is an apparatus and/or method such as a container or holster that conceals valuables such as firearms such that they may be securely carried by a user, while allowing for quick and easy removal of the items or firearm when desired by a user. It would further be desirable that such a container be lockable by a user, either locally or remotely, that the container be capable of reporting its geolocation and status to a remote user, and that the container, which may be a firearm holster, trigger the operation of certain safety or information-gathering devices such as cameras or microphones when the firearm is removed from the holster.

DISCLOSURE OF THE INVENTION

The present invention comprises an apparatus and method that have one or more of the following features and/or steps, which alone or in any combination may comprise patentable subject matter.

The present invention overcomes the shortcomings of the prior art in that it provides an apparatus and method for a container or holster that conceals valuables such as firearms such that they may be securely carried by a user while allowing for quick and easy removal of the firearm contained therein when desired by a user; is remotely lockable; and may provide geolocation information to a remote monitor. Removal of a firearm from the container may trigger the operation of certain safety or information-gathering devices such as cameras or microphones when the firearm is removed from the holster. Such microphones or cameras which may be in electrical or wireless communication with the container or may independently be in wireless communication with a remote monitor. In this manner, a user may withdraw a firearm from the holster, triggering operation of a camera or microphone for the transmittal of video, still images, audio data or other information to a remote monitoring site. In an embodiment, both video and audio data may be transmitted to a remote monitoring site. Thus, video and/or audio data may be transmitted, for example, to a law enforcement monitoring site such as a headquarters or station house, where a police officer's tactical situation may be observed by others such as superior officers or tactical specialists. Also, the remote monitor at the station house may remotely lock the container of the invention, preventing unauthorized access to a law enforcement officer's firearm. This feature may be helpful for example when a law enforcement officer has been incapacitated. This feature may thus prevent unauthorized access and/or use of the officer's firearm when the officer is unable to prevent such unauthorized access themselves.

In accordance with one embodiment of the present invention, the invention comprises a container that may, but does not necessarily, operate as a holster and may further comprise an optional geolocation receiver such as a GPS receiver for geolocation of the portable safe and its contents; a processor for executing non transitory computer executable instructions sored in a computer readable medium such as an electronic memory, and may comprise one or more means for communication with a remote user or system, such as a remote user data interface that may include radiofrequency wireless or optical communications transceivers, wired data communications ports and the like, in any combination and in any number. A remote user may be able to track the geographic location of a portable safe of the invention and its contents by utilizing received geo-positioning information, such as through a GPS receiver, or cell-based geolocation information, that is reported from the container of the invention to a remote user; or geolocation information regarding the geographic location of the portable safe may be independently reported from cell towers and data network systems to which the portable safe is wirelessly connected through radiofrequency or other wireless communications means such as, for instance and not by way of limitation, cellular communication systems such as Global System for Mobile Communications, or GSM; analog data networks; wireless Local Area Networks (LANs) such as Wi-Fi; point to point communication systems such as Bluetooth®; or any other radiofrequency or optical communication systems known in the art. The portable safe may also report its condition and/or status, such as "open", "closed", "locked" or "unlocked" to a user such as a remote user communicating with the portable safe via a wireless network in communication with the world wide web.

The container may comprise a spring-loaded retractable cover mechanism that is remotely lockable. A firearm may be retained in the container by a barrel pin attached to an interior surface of the enclosed volume allowing a firearm to be inserted onto the barrel pin by sliding the barrel of the firearm onto the barrel pin, forming a sliding engagement between barrel pin and firearm barrel. In any of the embodiments of the container claimed and described, the barrel pin may be long enough to prevent a full sliding engagement with a firearm that has an ammunition round chambered. In any of the embodiments using this long barrel pin feature, the "long barrel pin embodiment", the barrel pin length is defined to be longer that the length of the open space in the firearm barrel when an ammunition round is chambered in the firearm. "Preventing a full sliding engagement", as used herein, means that when a firearm is slidingly engaged with the barrel pin of the invention such that the barrel pin is inserted as far as is possible into the firearm barrel, the barrel pin is in physical contact with the chambered ammunition round preventing the firearm from sliding further onto the barrel pin, such that the firearm is not fully seated on the barrel pin, and the retractable cover of the invention is not able to be disposed into a closed position because it cannot be closed around the firearm due to a portion of the firearm, such as, for example, the handle, physically preventing closure of the retractable cover. This safety feature ensures that, for the long barrel pin embodiment of the invention, only firearms that do not have an ammunition round chambered may be carried in this embodiment of the invention, preventing accidental discharge when placing the firearm onto the barrel pin or removing it from the portable safe. For purpose of this description, "ammunition round" means a cartridge having a bullet as may be inserted into the chamber of a firearm, and fired, projecting the bullet through and out of the firearm barrel. In other embodiments of the invention, the container comprises a short barrel pin which allows full sliding engagement between the barrel pin and a firearm containing an ammunition round that has been chambered in the firearm, which means that when a firearm is slidingly engaged with the barrel pin of the invention such that the barrel pin is inserted as far as is possible into the firearm barrel, the barrel pin is not in physical contact with the chambered ammunition round, and the retractable cover of the invention is able to be disposed into a closed position. The short barrel pin embodiment of the invention is useful for situations in which a user desires to carry a firearm with a round chambered in the container of the invention so that the firearm is available for instant firing once withdrawn from the container. The short barrel pin embodiment may thus be desirable for personal defense or law enforcement use. The long barrel pin embodiment may be desirable for shipping or transport of firearms.

In accordance with an embodiment of the container of the invention, the lock of the invention may be an electromechanical latch in electrical communication with a controller so that it may be controlled into a latched (locked) or an unlatched (unlocked) condition, and further in mechanical communication with the retractable cover of the invention. When the electromechanical latch is in a locked or latched condition the retractable cover is prevented from retracting into the retracted position. When the electromechanical lock is in a locked condition, the retractable cover cannot be manually operated into an open, or retracted, position by the user. The electromechanical latch may be commanded by the controller into a "locked" state or an "unlocked" condition by the processor. The processor may be instructed to command the electromechanical latch by a remote user using a wireless interface to communicate with the processor, which interface may be an optical or a radiofrequency wireless interface. For example, the lock or unlock instruction may be generated by a user using a mobile computing device such as a tablet or cell phone, or the command may be generated by a user using a personal computer or any other electronic device that is in communication with the processor through the world wide web or any communication channel. The container of the invention, as described further below, comprises a controller in communication with radiofrequency and optical transceivers such that it is also connected to the Internet and is addressable using, for example, an Internet protocol address. Thus, a user may enter a command from a remote electronic device, which command is transmitted through the Internet and received by the container, and which is further received by the controller within the container. The controller may then execute computer readable and executable non-transitory instructions to process the command received from the remote user to command the electromechanical latch into a locked or unlocked condition. The container may further be commanded into a locked condition when a device such as a key fob is no longer within operable distance as described further below.

Any embodiment of the invention may further comprise geo-positioning electronic components such as a geolocation receiver, which may be a Global Position System (GPS) receiver, capable of receiving geo-locating signals from, for example, remote transmitters such as, but not limited to, GPS or other geo-positioning satellites, processing said geo-locating signals, and transmitting a signal comprising geolocation information through a remote user data interface to a remote user who, for example, may communicate with a container of the invention through a world wide web interface on the internet that is in data communication with the portable safe through the user data interface. The container may further comprise a controller capable of executing non-transitory computer executable instructions stored in a non-transitory computer readable medium that is in communication with the controller; a battery or other power source in electrical communication with the controller and non-transitory computer readable medium; and a wired electrical interface, which may be, for example an electrical communications port such as a Universal Serial Bus (USB) port or parallel data port in communication with the non-transitory computer readable medium and controller for programming the non-transitory computer readable medium by communicating computer executable instructions to the non-transitory computer readable medium for storage and later retrieval and execution by the controller. The controller and battery or other power source may be in electrical communication with the GPS receiver. Likewise, in the second embodiment, the controller and battery or other power source may be in electrical communication with the electromechanical latch so that the controller may command the electromechanical latch into any of the states or conditions described herein.

In an alternate embodiment, the geolocation receiver may comprise a wireless transceiver such as an RF transceiver capable of communicating with a remote wireless receiver for the purpose of transmitting a signal comprising geolocation information to a remote receiver without the need to transmit the signal comprising geolocation information through a controller to a remote receiver. In this embodiment, the container of the invention may thus comprise the ability to transmit a signal comprising geolocation information to a remote receiver without the need for a controller or separate wireless transceiver.

The present method and device of the invention overcome the shortcomings of the prior art by providing a holster that conceals valuables such as firearms such that they may be securely carried by a user, while allowing for quick and easy removal of the items or firearm when desired by a user. The portable safe be lockable by a user, either locally or remotely, that the portable safe be capable of reporting its geolocation and status to a remote user, and that the container, which may be a firearm holster, trigger the operation of certain safety or information-gathering devices when the firearm is removed from the holster.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating the preferred embodiments of the invention and are not to be construed as limiting the invention. In the drawings.

BEST MODE FOR CARRYING OUT THE INVENTION

The following documentation provides a detailed description of the invention. Although a detailed description as provided in the attachments contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus the scope of the invention should be determined by the appended claims, including any amendments thereto, and their legal equivalents, and not merely by the preferred examples or embodiments given.

As used herein, "memory", "medium", "media", "computer readable memory", "computer readable medium", "storage media", "computer readable storage media" and "computer readable storage medium" shall include within their meanings only physical non-transitory computer readable hardware, and such terms shall specifically exclude signals per se, carrier waves, propagating signals and other transitory signals. Such physical non transitory computer readable media may comprise hardware memory that comprises a physical structure for storing data which may include computer executable instructions or data.

As used herein, the terms "portable safe" or "safe" have the same meaning as "container".

As used herein, "remote user data interface" means one or any combination of wired or wireless communications interfaces known in the art including wired serial buses such as USB, RS-232 or other serial data interfaces; wired parallel data buses; radiofrequency or other wireless communications means such as, for instance and not by way of limitation, cellular communication systems such as CDMA or Global System for Mobile Communications, or GSM; analog data networks including cellular data networks; wireless Local Area Networks (LANs) such as the Institute of electrical and Electronic Engineers (IEEE) 802.11 standard known as Wi-Fi®; point to point communication systems such as Bluetooth®; infrared optical communications systems; RFID systems; Near Field Communication (NFC) systems or any other radiofrequency or optical communication systems known in the art in which a remote user can communicate with a local device either directly or through data interfaces with the world wide web.

Figure 1:
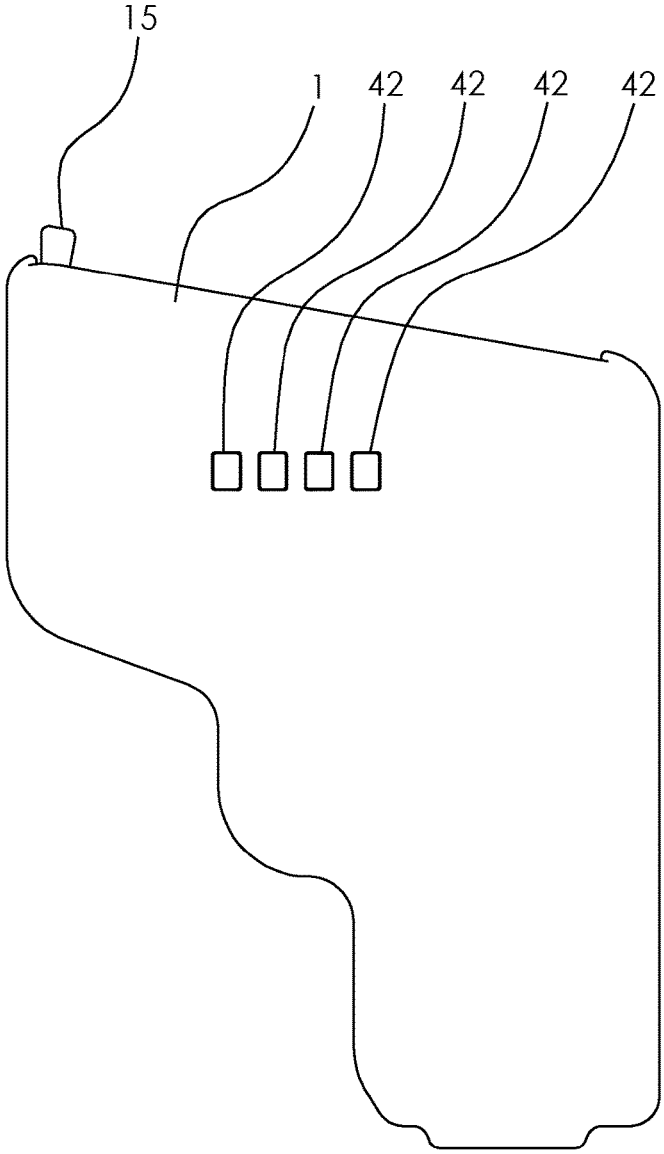
FIG. 1 depicts an orthogonal side view of the container of the invention.

Referring now to FIG. 1, a side view of an embodiment of a container of the invention 1 is depicted. The container may form an enclosed volume having an enclosed interior volume comprising interior surfaces and also having an opening A that may be covered by a retractable cover 13 (depicted in FIGS. 3, 4 and 5). The container may be used to contain valuables such as firearms. It is understood that the container may be utilized to carry any object as may be desired by user although in the figures of the drawings firearms are depicted as being carried within the container. It is thus within the scope of the claims that the container may be utilized to carry not only firearms but other objects as well, and in fact may carry any object desired by a user. Depicted in FIG. 1 are pushbuttons or keypad 42, which are in electrical communication with the electrical components 41 of the container by electrical wiring or other connection means as may be known in the electrical arts. Retractable cover 13 is depicted as well as cover stop 15.

Figure 4:
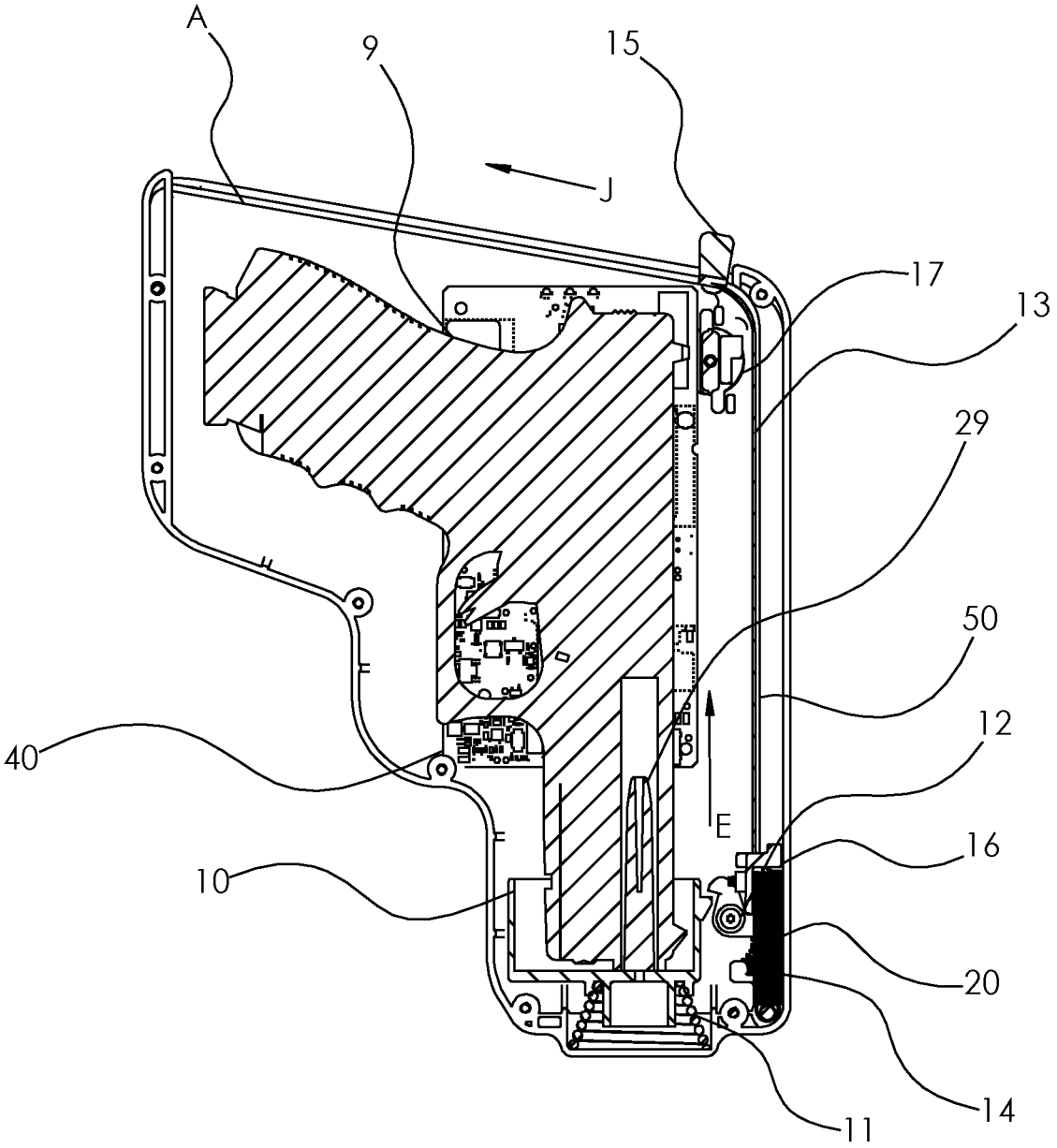
FIG. 4 depicts a cross sectional view of the interior of an embodiment of the container of the invention showing a firearm releasably slidingly engaged on a barrel pin and showing the firearm in a down and locked position, and further showing the spring-loaded pawl of the invention in an un-latched position. This figure depicts the state of the firearm, barrel receiver and first compression spring just after the spring-loaded pawl has been rotated into an unlatched condition and just before the first compression spring expands to motivate the firearm upwardly so that a portion of the firearm extends through an opening in the container that is opened when the retractable cover is motivated into a retracted, or open, position. In this view, the opening A is depicted as being in the top of the container.
Figure 5:
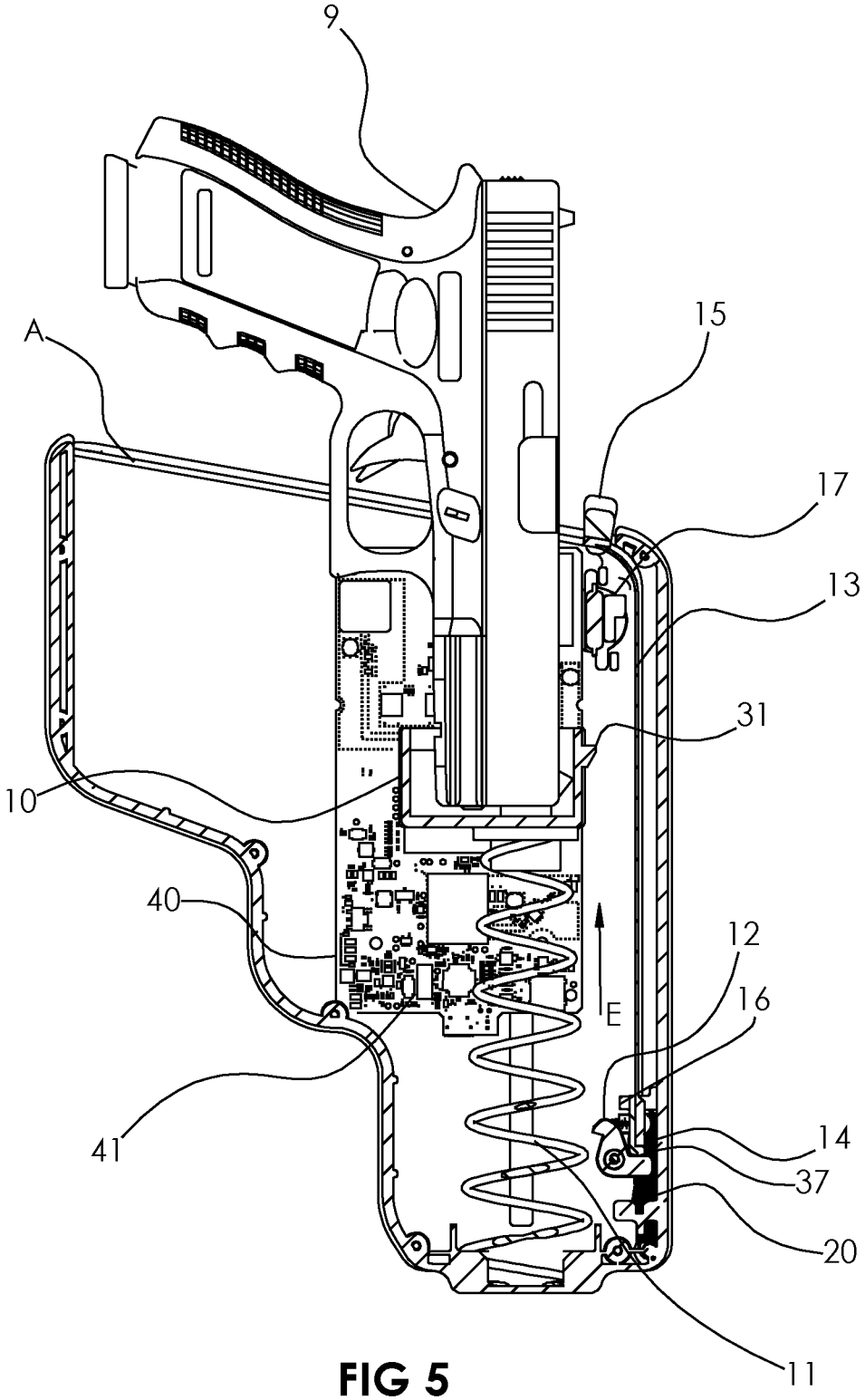
FIG. 5 depicts a cross sectional view of the interior of an embodiment of the container of the invention showing a firearm releasably engaged on a barrel pin and showing the firearm in an extended position in which the first compression spring has motivated the firearm and barrel receiver in an upwards direction, causing a portion of the firearm to extend through an opening in the container of the invention. In the embodiment shown, the opening is in the top of the container.

Still referring to FIG. 1, mechanical release 17 may be utilized by a user to cause retractable cover 13 (not shown in FIG. 1 but shown in FIGS. 3, 4 and 5) to retract into an open, or retracted, position. In operation, when a user desires to access a firearm disposed within the interior volume of the container 1 of the invention, the user depresses mechanical release 17 which releases a tension spring 14 (not shown in FIG. 1 but shown in FIGS. 3, 4 and 5) disposed within the interior volume of the container, causing the retractable cover 13 to retract into the enclosed interior volume of the container. When retractable cover 13 retracts into a retracted, or open, position as further depicted in FIGS. 4 and 5, the container opening, depicted as A in FIGS. 4 and 5, becomes uncovered, and a firearm contained within the interior volume of the container may be motivated into an extended position where it is readily accessible by a user, as depicted in FIG. 5, by operation of a first compression spring 11. This is explained in further detail in the discussion regarding FIG. 5 below.

Figure 2:
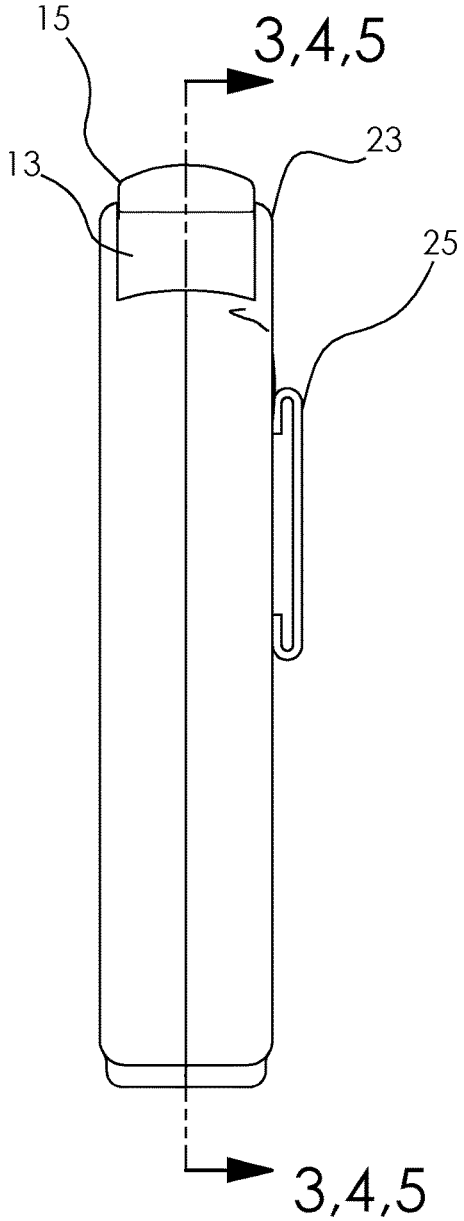
FIG. 2 depicts an orthogonal rear view of the container of the invention further showing a belt clip for use by a user in carrying the container on the body of the user.

Referring now to FIG. 2, a rear view of the container of the invention is depicted. In use, the container of the invention may be, but is not necessarily, carried on a person by means of a belt clip 25. It is to be understood that belt carry is just one of many uses of the container of the invention, and that the container may be utilized in a vehicle, boat, motorhome, home, or any other environment desired. The container of the invention may be utilized by a user for carrying in a vehicle or in any other circumstance or situation which a user may desire to carry a firearm or other valuables in a lockable container while still having the ability to quickly access the contents of the container. In such uses, the container may be attached to an interior surface of a vehicle, such as the side of a console. The container of the invention 1 may be comprised of one or more exterior components together forming an outer surface, and forming enclosed interior volume, and having a top surface 23 as depicted in FIG. 2. Retractable cover 13 and retractable cover stop 15 are shown for reference. The exterior surface may take any desired shape. It does not necessarily need to conform to the shape depicted in the drawings. Furthermore, the components forming the exterior shape and enclosed interior volume may be fabricated in any number of pieces that are attached together to form the exterior shape. In the figures, a best mode comprising two pieces, which may be molded, cast, forged, manufactured by additive manufacturing, machined or fabricated by any means, is depicted. The two pieces come together, forming the exterior shape and enclosed interior volume. A seam line between the two pieces is depicted in FIG. 6. However, any number of pieces may comprise exterior surfaces of the invention.

Figure 3:
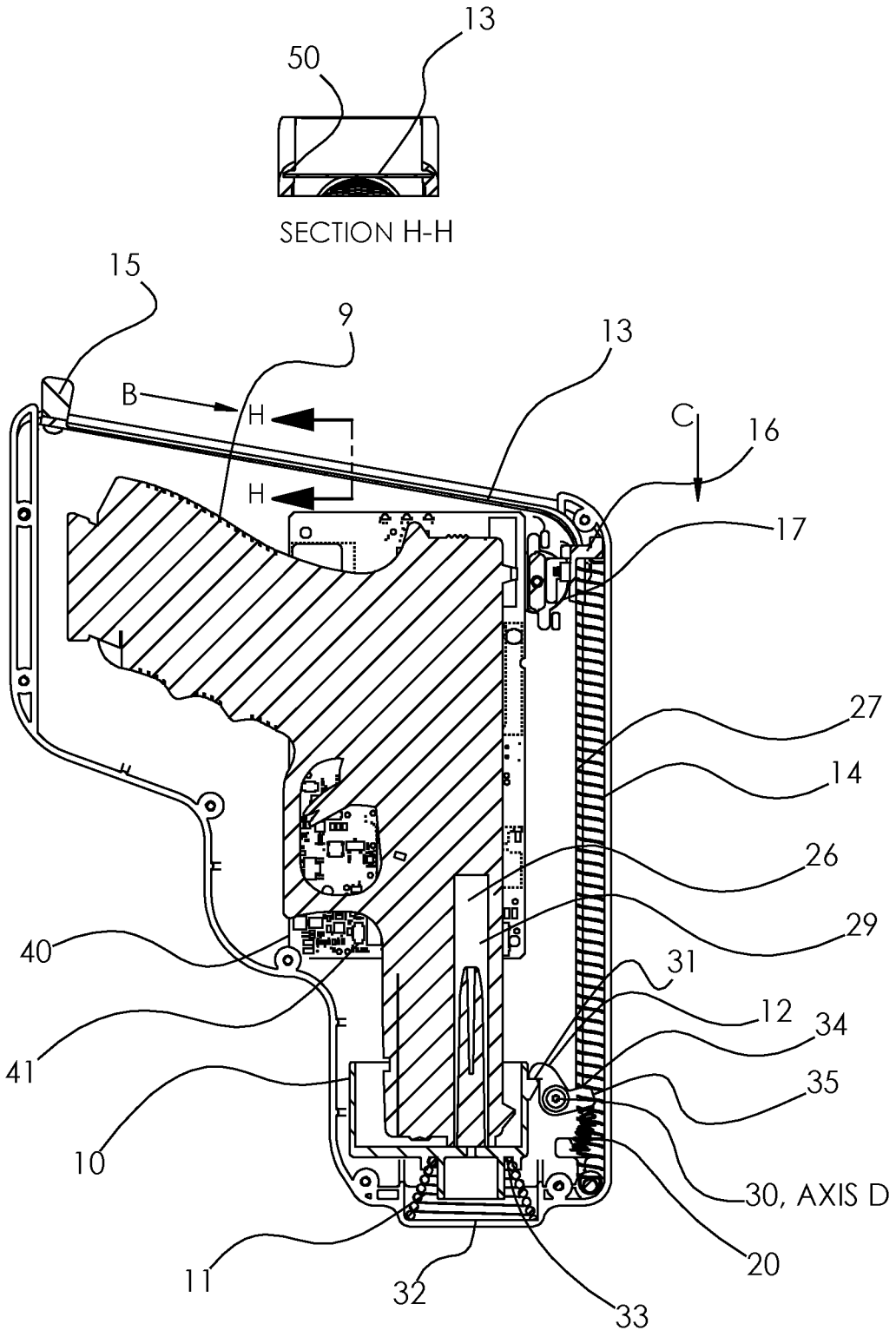
FIG. 3 depicts a cross sectional view of the interior of an embodiment of the container of the invention showing a firearm releasably slidingly engaged on a barrel pin and showing the firearm in a down and latched position where it is securely retained inside the enclosed volume of a container of the invention. The retractable cover of the invention is shown in a closed, or un-retracted position.

Referring now to FIG. 3, a cross sectional view of the interior of an embodiment of the container of the invention showing a firearm releasably slidingly engaged on a barrel pin is shown. A firearm 9 is shown mounted onto barrel receiver 10 which further comprises barrel pin 29 disposed on an upper surface of barrel receiver 10. Firearm 9 is shown disposed in a down and latched position where it is securely and completely retained inside an enclosed interior volume of a container of the invention; thus, in the closed position, the enclosed interior volume of the container entirely enclosed handgun 9. While the scope of the invention is not to be limited in physical size, typical handguns may comprise overall length in the barrel direction of between 7.6 cm and 40 cm, and overall height in the handle dimension of 6 cm to 22 cm, with widths ranging from 1.3 cm to 3 cm. Thus the interior enclosed volume may take on dimensions of commensurate size to entirely enclose such handgun sizes when retractable cover 13 is closed. However, it is to be understood that these dimensions are exemplary only and the interior enclosed volume may take any desired shape or dimension. The retractable cover 13 of the invention is shown in a closed, or un-retracted, position, in which it occludes opening A. Cover 13 is latchable into a closed, or un-retracted, state against the opening force provided by tension spring 14 by mechanical release 17 as further discussed in relation to FIG. 6B. The opening force provided by spring 14 is applied to a first end of cover 13 where spring 14 attaches to cover 13, and is also applied to an interior surface of the enclosed interior volume where tension spring 14 attaches to the enclosed interior volume. Cover stop 15 is attached to a surface of retractable cover 13 and is used to prevent retractable cover 13 from retracting fully into the interior enclosed space of the container when the cover is retracted as depicted in FIGS. 4 and 5. Barrel pin 29 allows a firearm 9 to be inserted onto the barrel pin by sliding the barrel 26 of the firearm onto the barrel pin, forming a sliding engagement between barrel pin 29 and the firearm barrel 26. In any of the embodiments of the container claimed and described, the barrel pin 29 may be long enough to prevent a full sliding engagement with a firearm 9 that has an ammunition round chambered. In any of the embodiments using this long barrel pin feature, the barrel pin length is defined to be longer than the length of the open space in the firearm when an ammunition round is chambered in the firearm. "Preventing a full sliding engagement", as used herein, means that when a firearm barrel 26 is slidingly engaged with barrel pin 29 such that the barrel pin 29 is inserted as far as is possible into firearm barrel 26, the barrel pin is in physical contact with the chambered ammunition round, preventing the firearm from sliding further onto barrel pin 29, and the retractable cover 13 of the portable safe is not able to be disposed into a closed, un-retracted position because it cannot be closed due to a portion of the firearm, such as, for example, the handle, physically interfering with the retractable cover 13 and thereby preventing closure of retractable cover 13. In this embodiment of the barrel pin, this safety feature ensures that only firearms that do not have an ammunition round chambered may be carried in this embodiment of the invention, preventing accidental discharge when placing firearm onto barrel pin 29 or removing it from the container. For purpose of this description, "ammunition round" means a cartridge having a bullet as may be inserted into the chamber of a firearm, and fired, projecting the bullet through and out of the firearm barrel. In other embodiments of the invention, the container comprises a short barrel pin 29 which allows full sliding engagement between the barrel pin 29 and a firearm containing an ammunition round that has been chambered in the firearm, which means that when a firearm containing a chambered round is slidingly engaged with the barrel pin 29 of the invention such that the barrel pin is inserted as far as is possible into the firearm barrel 26, the barrel 29 pin is not in physical contact with the chambered ammunition round, and the retractable cover 13 of the invention is able to be disposed into a closed, or un-retracted, position. The short barrel pin embodiment of the invention is useful for situations in which a user desires to carry a firearm with a round chambered in the container of the invention so that the firearm is available for instant firing once withdrawn from the container. The short barrel pin embodiment may thus be desirable for personal defense or law enforcement use. The long barrel pin embodiment may be desirable, for example, in the shipping or transport of firearms.

Still referring to FIG. 3, mechanical release 17 may be operated by a user depressing mechanical release 17 which releases tension spring 14, which is held in tension when retractable cover 13 is in a closed, or un-retracted, position. Tension spring 14 provides an opening force on cover 13. The release of tension spring 14 causes retractable cover 13 to retract in the directions of arrows B and C. The release of tension spring 14, as described further in relation to FIG. 18, results in operation of the opening force provided by tension spring 14 causing retraction of retractable cover 13 into the interior enclosed volume of the container as further depicted in FIGS. 4, 5 and 6B.

Still referring to FIG. 3, the invention may further comprise a spring-loaded pawl 12 rotable on pin 30 forming an axis of rotation D, said spring-loaded pawl 12 rotably attached to pin 30, and pin 30 in turn attached to at least one interior surface of said enclosed volume either directly or indirectly. The barrel receiver 10 may further comprise a surface 31 for latching when a latch comprised of spring loaded pawl 12 is rotated into a latched position as shown in FIG. 3. A first compression spring 11 provides an expanding upward force in the direction of arrow E (see FIG. 4) on the lower surface of barrel receiver 10 and is disposed within said enclosed volume, the first compression spring 11 having a first end 32 in contact with an interior surface of said enclosed interior volume and a second end 33 in contact with a lower surface of barrel receiver 10. First compression spring 11 is compressed when said retractable cover is in a un-retracted position as shown in FIG. 3. Spring-loaded pawl 12 is biased into a latched position by operation of a second compression spring 20, or, alternatively by a torsion spring around pin 30. The latched position is defined as the position that occurs when the surface for latching 31 is in contact with a surface of spring-loaded pawl 12 when spring-loaded pawl 12 is held in the latched position shown in FIG. 3 by operation of second compression spring 20, preventing first compression spring 11 from expanding and thus preventing the motivation of barrel receiver 10 and firearm 9 into an extended position. Spring loaded pawl 12 is rotable into an unlatched position (shown in FIGS. 4 and 5) by application of a downward force on 34 surface of said pawl by block 16 when cover 13 is retracted, which force may motivate tang 35 of spring loaded pawl 12 in a downward direction, against the biasing force provided by second compression spring 20, rotating pawl 12 clockwise and compressing second compression spring 20, as is depicted in FIGS. 4 and 5 and described below. A printed circuit board or other electrical connection substrate 40 may contain the electrical circuit components 41 described below and depicted in FIG. 8. Printed circuit board 40 may be attached to any interior surface of the interior enclosed volume of the container. Section H-H of FIG. 3 depicts a cross section view of an edge of retractable cover 13 slidingly engaged in track 50, providing a sliding engagement between retractable cover 13 and track 50 which is formed in at least one interior surface of the enclosed interior volume of container 1.

Referring now to FIGS. 4 and 5, cross-sectional views of the interior enclosed volume of an embodiment of the container are depicted. In FIG. 4 a cross sectional view of the interior enclosed volume of an embodiment of the container of the invention showing a firearm 9 slidingly engaged on a barrel pin 29 and showing the firearm 9 in a down position, and further showing the spring-loaded pawl 12 of the invention in an un-latched position. FIG. 4 depicts the state of the firearm 9, barrel receiver 10 and first compression spring 11 just after the spring-loaded pawl 12 has been rotated into an unlatched position on pin 30 (shown in FIG. 3) by operation of the retractable cover 13, discussed further below, and just before the first compression spring 11 expands to motivate the barrel receiver 10 and firearm 9 upwardly in the direction of arrow E through an opening A in the container. In this view, opening A is depicted as being in the top of the container. In FIG. 5, a cross sectional view of the interior of an embodiment of the container of the invention showing a firearm releasably slidingly engaged on a barrel pin 29 and showing firearm 9 in an extended position in which the expansion of first compression spring 11 has motivated firearm 9 and barrel receiver 10 in an upwards direction E, causing a portion of the firearm to extend through an opening A in the container of the invention so that it is readily accessible by a user. In the embodiment shown, the opening is in the top of the container.

Figure 6A:
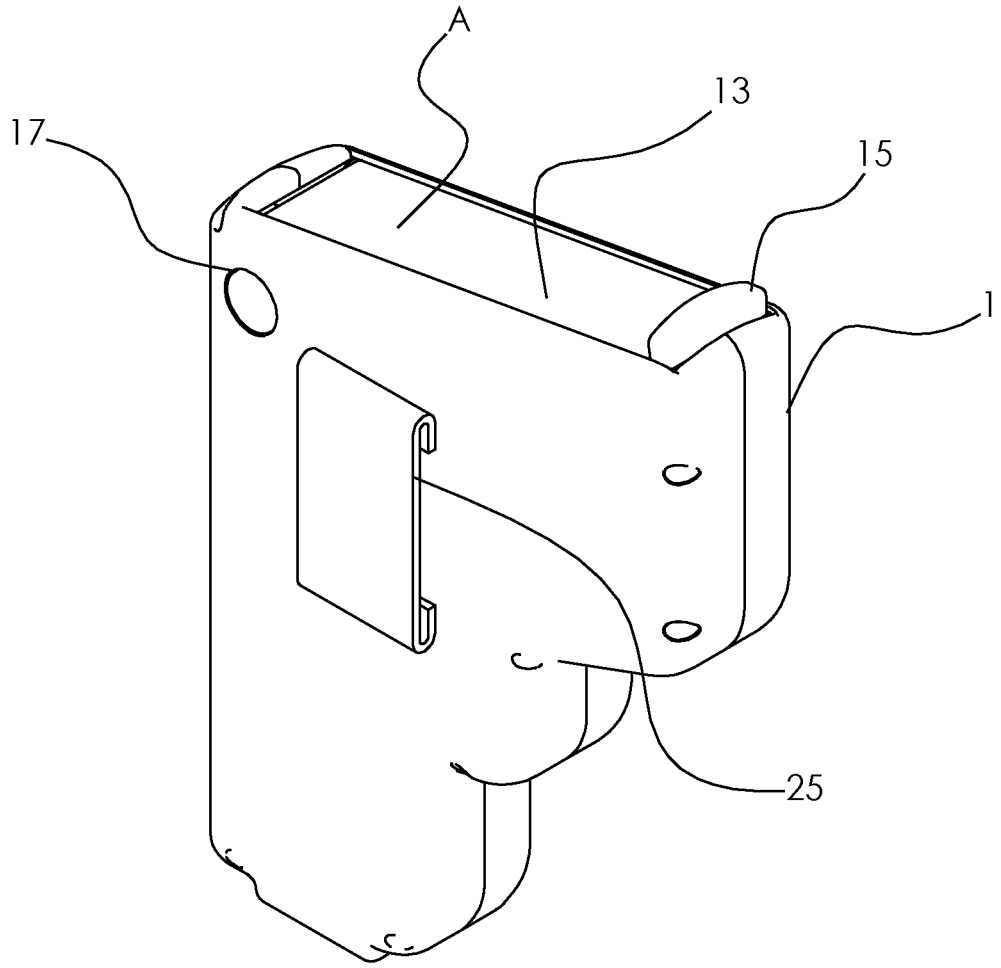
FIG. 6A depicts a perspective view of an embodiment of the invention in which the retractable cover is disposed in a closed, or un-retracted, position. A firearm or other object carried within an interior enclosed volume of the container is not immediately accessible by the user.
Figure 6B:
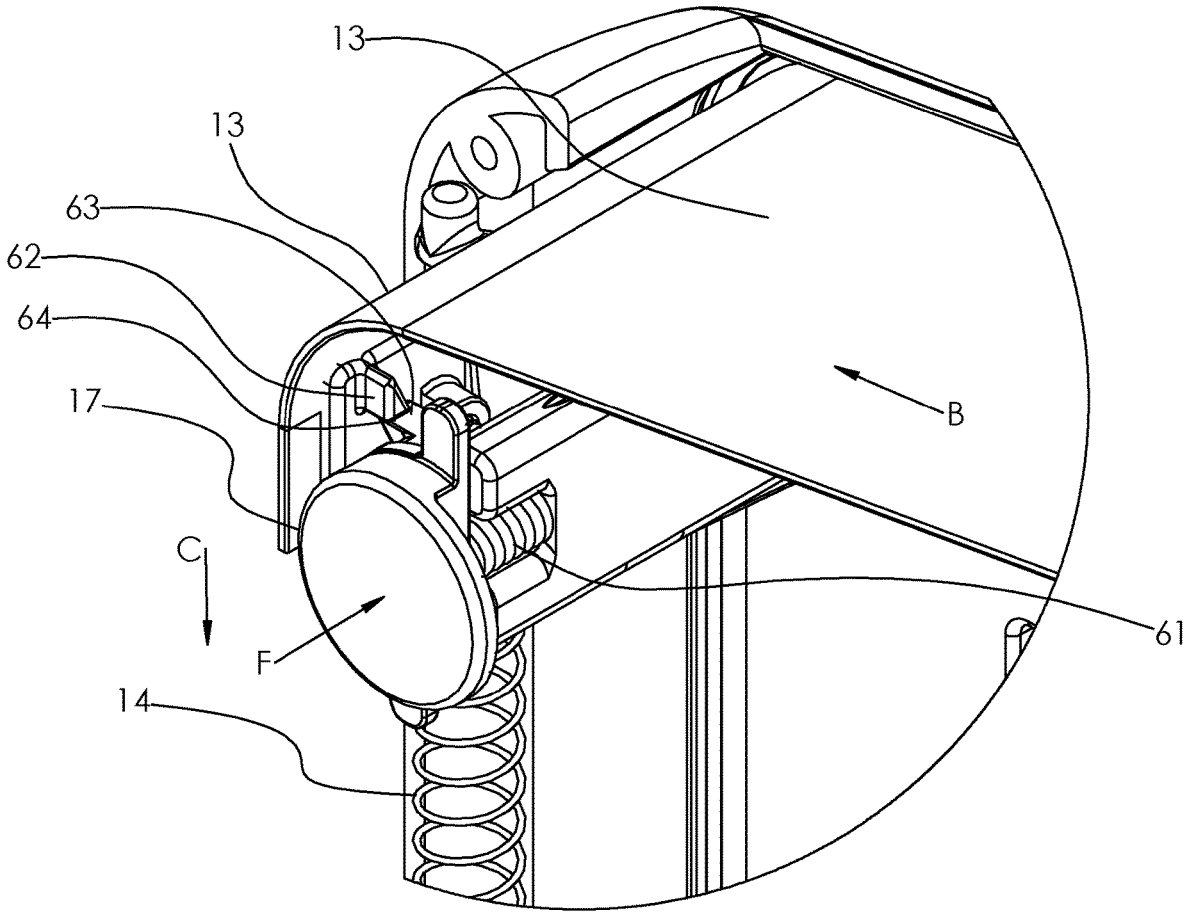
FIG. 6B depicts a sectional view of the spring-loaded release mechanism that, when depressed, releases the retractable cover to be motivated into a retracted, or open, position from a closed, or un-retracted, position.

Still referring to FIGS. 4 and 5, retractable cover 13 may be retracted as described above when a user depresses mechanical release 17 as further discussed in relation to FIG. 6B. When retractable cover 13 is retracted by operation of tension spring 14, the retractable cover 13 may be motivated along track 50, which may act as a bearing surface upon which retractable cover 13 slides and changes direction from the direction B to the direction C as is shown by the arrows B and C in FIG. 3. Retractable cover 13 may comprise block 16 attached to, or formed as a part of, retractable cover 13. Retractable cover 13 may comprise at least one edge disposed in a sliding engagement with track 50 (shown in cross section FIG. 3) for receiving the edge; track 50 may take any cross sectional form or shape but may be a groove disposed in an interior surface of the container that accepts at least one edge of retractable cover 13 in a sliding engagement. One exemplary cross sectional shape of the sliding engagement of the track 50 for guiding retractable cover 13 is a tongue and groove shape, with the groove formed in an interior surface of the container, and the tongue formed by an edge of retractable cover 13. Another cross sectional shape for the sliding engagement is for the edge and track 50 to comprise complimentary dovetail shapes in a sliding engagement. The track 50 may be formed in the interior surfaces of the container and guide retractable cover 13 in the manner depicted in FIGS. 4 and 5 (in other words, in the direction of arrows B and C as shown in FIG. 3). When retractable cover 13 is retracted, block 16 travels in a downward direction and contacts surface 37 of spring-loaded pawl 12, causing spring-loaded pawl 12 to rotate on pin 30 (shown in FIG. 3) such that it is rotated into an unlatched condition. In this manner, retraction of retractable cover 13 causes the unlatching of barrel receiver 10 and allows barrel receiver 10 and firearm 9 to be motivated in an upwards direction depicted as arrow E as first compression spring 11 is allowed to expand towards an uncompressed state, the motivation being towards opening A by the expanding upward force of spring 11. Handgun 9 is thus motivated upward in the direction of arrow E, where at least a portion of handgun handle 9 protrudes through opening A. The unlatched position is defined as spring-loaded pawl 12 being rotated into an unlatched position allowing first compression spring 11 to expand thereby motivating said barrel receiver 10 and firearm 9 upward into an extended position as depicted in FIG. 5. When the retractable cover 13 is motivated back into a closed position as depicted in FIG. 3, block 16 is no longer in contact with surface 37 of spring-loaded pawl 12, and thus spring-loaded pawl 12 is rotated back into a latched condition by operation of the expansion of second compression spring 20. Printed circuit board 40 and electrical components 41 are depicted for reference. Surface 31 of pawl 12 is shown for reference. Retractable cover stop 15 contacts an edge of opening A when retractable cover 13 is in a fully retracted state and prevents cover 13 from being retracted further than is shown in FIG. 5.

Retractable cover 13 may comprise any bendable material or combination of materials. For instance, retractable cover 13 may be fabricated from spring sheet steel, or may be fabricated from any plastic material. Retractable cover 13 may also be fabricated from a plurality of stiff members attached to a bendable substrate such as spring sheet steel, plastic, or cloth material. Retractable cover 13 may be fabricated from any material or combination of materials known by a person of ordinary skill in the art as being suitable for retractable, bendable covers as may be known in the mechanical arts.

Referring to FIGS. 3 and 5, when it is desired to return retractable cover 13 to a closed, or un-retracted position such that contents within the container are secure, a user may motivate handgun 9 downward (opposite the direction of arrow E) until pawl 12 again latches barrel receiver 10 in the latched position by the force applied by second compression spring 20, as shown in FIG. 3. A user may then motivate cover 13 in the direction of arrow D by, for example, placing a thumb or finger on a surface of cover stop 15, and applying a force in the direction of arrow D. Cover 13 may then be motivated along track 50 to the closed, or un-retracted position.

Referring now to FIG. 6A, a perspective view of an embodiment of a container 1 is shown in which retractable cover 13 is in a closed position. In the closed position, or state, cover 13 occludes opening A. A firearm or other object carried within an interior enclosed volume of the container is not immediately accessible by the user. Cover stop 15 is attached to a surface of retractable cover 13 and is used to prevent retractable cover 13 from retracting fully into the interior enclosed space of the container when the cover is retracted. Belt clip 25 and mechanical release 17 are shown for reference.

Referring now to FIG. 6B, a sectional view of the spring-loaded release mechanism that, when depressed, releases the retractable cover to be motivated into a retracted, or open, position from a closed, or un-retracted, position is depicted. Tab 63 prevents tang 62, which is attached to retractable cover 13, from being motivated in a downward position by spring 14 when mechanical release 17 has not been depressed, by the interface between tab 63 and tang 62 at location 64. However, when mechanical release 17 is depressed in the direction of arrow F, tab 63 is also motivated in the direction of arrow F because it is attached to mechanical release 17. When mechanical release 17 is fully depressed, tab 63 no longer interferes with the downward motivation of tang 62 at location 64 because tab 63 has been motivated far enough that it no longer prevents tang 62 from being motivated downward in the direction of arrow C When tab 63 is thus disposed so that it no longer interferes with the downward motivation of tang 62, retractable cover 13 is allowed to retract in the direction of arrows B and C due to the force provided by spring 14. In this manner, retractable cover 13 is motivated in the direction of arrows B and C into an open, or retracted, position, so that cover 13 no longer occludes opening A and the enclosed interior volume of the container may be accessed. The container may comprise an electromechanical latch 621 for preventing or allowing the depression of mechanical release 17 upon command by processor 800. The electromechanical latch, which may be any form but may be, for example, a solenoid, may be in electrical communication with the electrical components 41, specifically processor 800, so that it may be commanded into a latched or locked state preventing the depression of mechanical release 17, or an unlocked or unlatched state in which a user is able to depress mechanical release 17. Controller 800 may command mechanical release 17 to a locked or latched state when user commands are received through wireless interface 806 or wired interface 606, or through pushbuttons 42. Controller 800 may execute non-transitory computer readable and executable instructions stored in computer readable media 810 to command mechanical release 17 to a locked or latched state which prevents depression of mechanical release 17.

Figure 7:
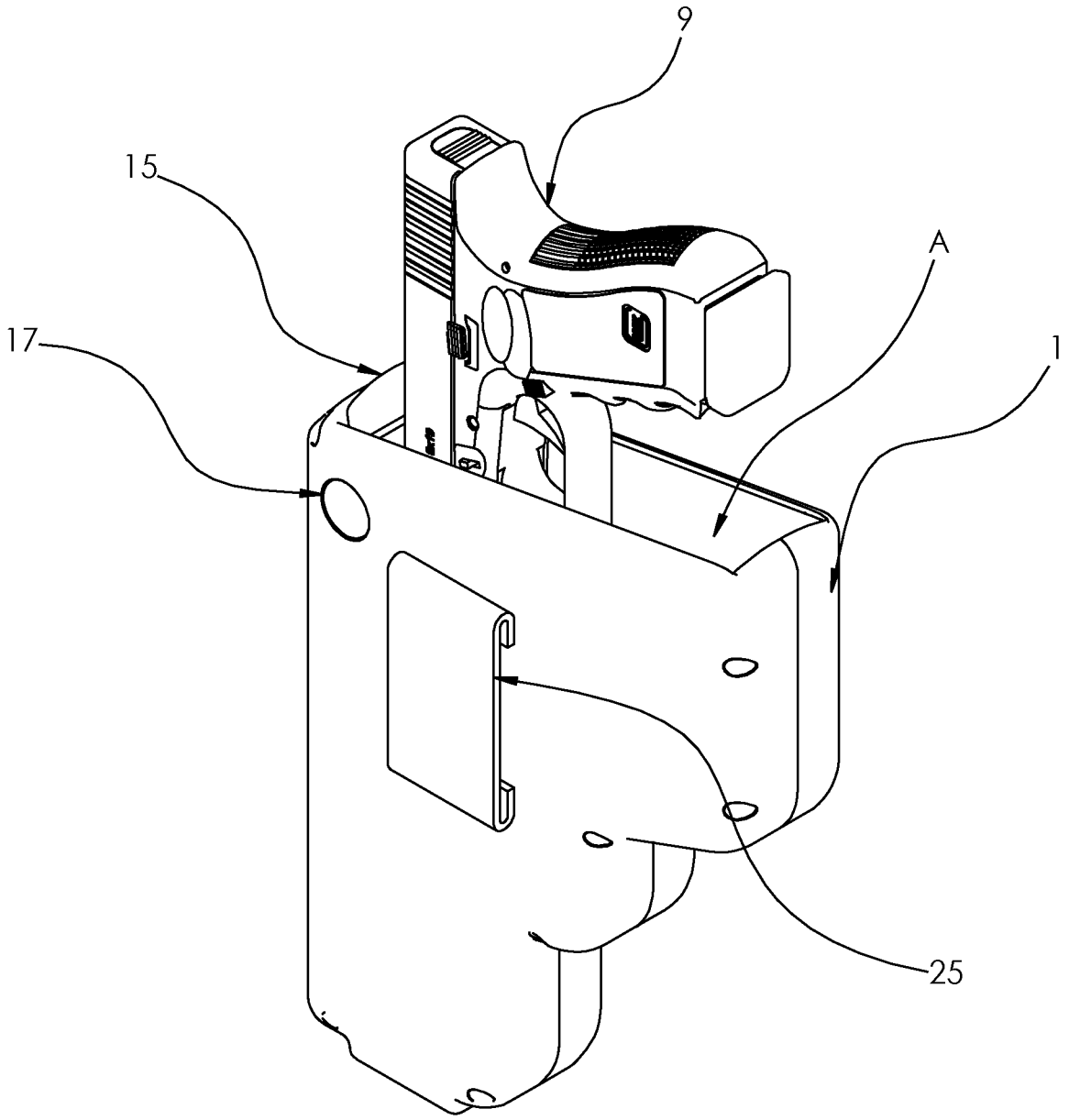
FIG. 7 depicts a perspective view of an embodiment of the invention in which the retractable cover is disposed in an open, or retracted, position. A firearm that has been contained within the container has been motivated upwards through an opening formed in a top surface of the container by the retraction of the retractable cover, and a first compression spring has motivated the firearm partially through the opening where it is immediately accessible by a user.

Referring now to FIG. 7, a perspective view of the container 1 is shown in which retractable cover 13 is in an open or retracted position, forming opening A in a surface of the container. Cover 13 has been released into the retracted position by a user depressing mechanical release 17. Cover stop 15 is shown for reference. A firearm 9 has been motived upwards by the expansion of first compression spring 11 as described herein. Belt clip 25 may comprise a belt clip open/close sensor 807 in the form of electrical contacts that are a closed electric circuit when no material, such as belt, is disposed between the members of belt clip 25, and which are an open electric circuit when material is disposed between the members of belt clip 25 such as when the container is worn on the belt of a user such the user's belt is disposed between the members of belt clip 25.

Figure 8:
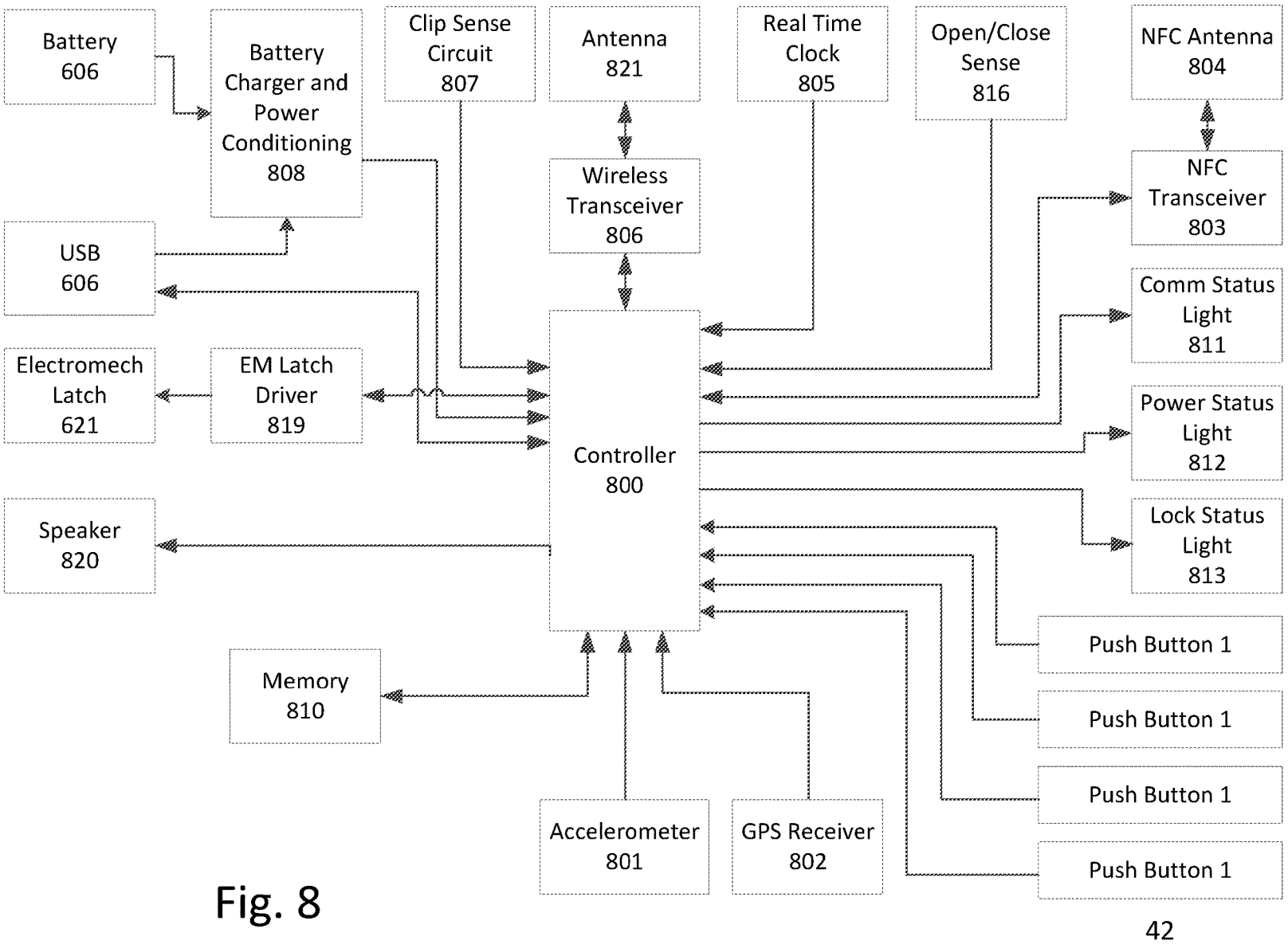
FIG. 8 depicts a block diagram of an embodiment of the portable safe of the invention.

As described in more detail below, the invention may comprise electrical components 41 as shown in FIG. 8 and which may be required to carry out the steps and features described herein. These electrical components 41 may be mounted onto a printed circuit card or other electrical connection substrate 40 or electrically connected via discrete wiring. The electrical components 41 of the system may comprise a controller 800 in electrical communication with a media for storing computer readable and executable non-transitory and structures such as, an electronic memory. Controller (or processor) 800 is capable of executing computer readable computer executable non-transitory instructions. The invention may further comprise a geopositioning radiofrequency receiver such as a GPS receiver for receiving geo-location signals from satellites or other transmitters, the geopositioning receiver being in electrical communication with the controller. Furthermore, the invention may comprise at least one wireless interface transceiver such as an optical transceiver, a wireless radiofrequency transceiver, and RFID tag, near field communication transceiver, or any other wireless transceiver known in the art, all of which may be an electrical communication with the controller. The transceivers of the invention may also be in communication with antennas, or in the case of the optical transceiver light emitting diodes, PIN diodes, or other receivers and transmitters of light energy. The invention may comprise one or a plurality of printed circuit boards upon which these electrical components may be mounted and the printed circuit boards may be in electrical communication with one another by electrically conductive wiring. The invention may further comprise a battery in electrical communication with the components described herein for providing electric power. The battery may be replaceable rechargeable and may be chargeable through wireless inductive charging means. The computer readable memory may contain computer readable and executable non-transitory instructions for carrying out the steps and features of the invention when these instructions are executed by the controller. The controller may be any controller, microprocessor, firmware controller, or any other combination of electrical components capable of reading and executing computer readable and executable non-transitory instructions.

In an embodiment of the invention, electrical sensors such as switches may be employed in electrical communication with the controller so that electrical signals are generated and communicated to the controller indicating that a firearm has been inserted into the container; the retractable cover is in a retracted position; or the retractable cover is in a non-retracted position. When a user causes the retractable cover to be motivated into the retracted position, the controller of the invention may execute computer readable instructions causing an optical or radiofrequency signal to be generated and transmitted to a remote monitoring station via, for example, Bluetooth, Wi-Fi, or other radiofrequency communication. Furthermore, when a user causes the retractable cover to be motivated into the retracted position such that a firearm may be withdrawn from the container, a signal may be generated by the controller and transmitted to a camera in proximity to the user, triggering the camera to begin recording video data or to begin taking a series of still images. The video data or still images may be transmitted to a remote monitor. Likewise a signal may be generated by the controller and transmitted to a microphone and recording device in proximity to the user, triggering the microphone and audio recording device to begin recording audio data or transmitting audio data to a remote monitor, or both. In a typical use of the invention, a law enforcement officer may cause the retractable cover of the invention to be motivated into a retracted position by pressing mechanical release 17, causing a firearm contained within the enclosed interior volume of the container to be motivated into an extended position such that it is readily available to the officer. When the retractable cover 13 is motivated into the retracted position, the retracted position status may be communicated to the controller by a sensor, which may be a switch which is closed when the retractable cover is motivated into the retracted position. The signal thus communicated to the controller may be used as an input by the controller to execute a series of executable instructions causing the transmission of a signal by either wireless or wired means to a remote camera such as a body camera worn by the law enforcement officer, a camera mounted in the law enforcement officers vehicle, or any other camera, to begin recording; and likewise audio recording may be commanded. It can thus be seen that the invention may be utilized by law enforcement to automatically operate video, audio, or other surveillance and recording means when they draw their firearm from the container.

Likewise, the controller of the invention may be utilized to transmit geolocation information received from GPS satellite signals, cellular towers, or other RF or optical means, to a remote monitoring station. In this use, it is possible for a remote monitoring station to ascertain geolocation information regarding the container by communicating with the container through a wireless world wide web interface.

In yet a further embodiment, the container may comprise accelerometers in electrical communication with the controller that are used to produce signals when the container is moved. The signals may be used as inputs by the controller, which then executes computer readable instructions to transmit a signal to a remote user indicating that the container has been moved.

In yet a further embodiment of the invention, the container may comprise temperature sensors in electrical communication with the controller that are used to produce signals communicating the temperature of the interior enclosed volume of the container. The signals may be used as inputs by the controller, which then executes non transitory computer readable instructions to transmit a signal to a remote user by any of the means described herein, indicating that a predetermined temperature limit has been exceeded, or providing the temperature within the enclosed interior volume of the container.

In yet a further embodiment of the invention the container may comprise an electromechanical latch 621 preventing the retraction of retractable cover 13. Electromechanical latch may be in electrical communication with the controller. The controller may execute instructions for operating the electromechanical latch 621. A user may transmit signals wirelessly to the container by optical or radiofrequency ("RF") means, which signals are received by the optical and/or radiofrequency receivers comprising the invention. These signals may be utilized as inputs by the controller for commanding electromechanical latch so that retractable cover 13 may be locked into a un-retracted position, or unlocked so that it may be motivated into a retracted position. The invention may therefore be remotely locked or unlocked. A typical use scenario for this feature occurs when the user has stored a firearm in the interior enclosed volume of the container as hereinbefore described and the retractable cover is in an un-retracted, or closed, position. The container may be useful, for transporting firearms in a vehicle. Thus, a user may utilize the container of the invention to securely transport firearms in a vehicle. If, for example, the user exits the vehicle leaving the container in the vehicle, the user may utilize a mobile device, tablet, cell phone, personal computer or other electronic device to remotely communicate with the container to command the container to remain in a locked condition, safely securing the firearm within the vehicle and preventing unauthorized access. The container may be remotely locked or unlocked in this matter, enabling a multitude of use scenarios in which a firearm may be placed in the container and securely locked remotely, preventing unauthorized access.

Referring now to FIG. 8, an electrical block diagram of an electronic embodiment of the container of the invention is depicted. Controller 800 may be in electrical communication with each of the other electrical components of the container of the invention as depicted in the diagram. Controller 800 may also be in electrical communication with non-transitory computer readable media 810. Non-transitory computer readable and executable instructions in the form of software, firmware, or other known forms of computer readable instructions capable of performing the functions described herein may be stored in a non-transitory fashion in non-transitory computer readable media 810. Controller 800 may access non transitory computer readable media 810 for the purpose of retrieving computer readable instructions stored thereon and executing said computer readable instructions so as to carry out the functions described herein. Controller 800 may also be in electrical communication with sensor devices such as one or more accelerometers 801 and temperature reading devices and other sensors as may be known in the art. In this manner controller 800 may retrieve or otherwise receive information from one or more accelerometers 801 one or other sensors in the form of sensor signals, and may use the data from the sensor signals to perform the functions of the invention by executing computer readable instructions it has retrieved from non-transitory computer readable media 810.

Still referring to FIG. 8, controller 800 may also be in communication with one or more pushbuttons or other user interface elements such as pushbuttons (or keypad) 42 for receiving control inputs from a user. User interface elements may be, for example, buttons or switches located on any surface of the container. Controller 800 may also be in electrical communication with a real-time clock or other internal timing device 805, and controller 800 may also be in electrical communication with interface devices such as radiofrequency or optical wireless transceiver 806 and near field communication transceiver 803. Near field communication transceiver 803 may also be in electrical communication with a near field communication antenna 804. Wireless transceiver 806 may also be any wireless transceiver known in the art and may be in electrical communication with a radio frequency (RF) antenna or optical transceiver 821 as depicted in the diagram. Wireless transceiver 806 may be any radiofrequency or optical wireless transceiver known in the art for communicating data to and from a remote system such as, by way of example and not by way of limitation, any digital or analog radio communication transceiver, any optical communication transceiver such as infrared and other optical communication transceivers, radio frequency transceivers designed to operate on the standard known as Wi-Fi, Bluetooth, or any other known standard radiofrequency data communication physical layer and protocol, cellular-based RF communication transceiver such as GSM or other transceivers capable of communicating with a cellular-based RF communications network as is known in the art, and any other radiofrequency or optical transceiver known in the art. It is reasonably anticipated that emerging wireless communication systems may replace those listed in this description and it is within the disclosure and claim of invention that future developed wireless communication systems are included within the scope of the wireless transceiver, which may comprise a plurality of transceivers, of the container of the invention. Controller 800 may also be in electrical communication with a data port 815 for programming non transitory computer readable media 810, commanding controller 800, reading information from non-transitory computer readable media 810 or the like. Data port 815 may be any electrical data communication port, and may be serial or parallel, but is preferably a Universal Serial Bus (USB) data port.

Still referring to FIG. 8, the remote user data interface of a container of the invention may comprise any one or any combination of radiofrequency or optical wireless transceiver 806, near field communication transceiver 803, and data port 815, in any number. Controller 800 may also be in electrical communication with a geolocation receiver 802, which may be a Global Position System (GPS) receiver, capable of receiving geo-locating signals from, for example, remote transmitters such as, but not limited to, GPS or other geo-positioning satellites, processing said geo-locating signals, and transmitting a signal comprising geolocation containing geolocation or time information, or both, for processing or retransmission by controller 800 executing non-transitory computer executable instructions stored in computer readable media 810 autonomously or when commanded by a remote user through wireless transceiver 806 or communication port 606.

Still referring to FIG. 8, controller 800 may also be in electrical communication with a electromechanical latch driver circuit 819 which is in electrical communication with a electromechanical latch, such as a solenoid, server motor or stepper motor, 621, for the purpose of receiving commands from controller 800 commanding motor 621 to dispose the electromechanical lock of the invention in a locked state or unlocked state. Electromechanical latch 621 may be configured so as to engage or disengage an electromechanical lock mechanism as described elsewhere herein upon command from controller 800. Thus, as an example, if a remote user desires to lock or unlock the container of the invention from a remote location, a command may be transmitted from the remote user by wireless means, for instance RF communication means such as GSM cellular transmission, which is received by the RF antenna container of the invention. The wireless antenna is in electrical communication with wireless transceiver 806 which receives the signal transmitted from the remote user and received by the RF antenna, whereupon the received signal may be communicated to controller 800. Controller 800 may then interpret the signal sent by the remote user by the execution of computer readable instructions as read from non-transitory computer readable media 810, were upon controller 800 may command motor driver 819 to operate electromechanical latch 621 to motivate the lock of the invention into a locked, or unlocked, position as commanded by the remote user. In this manner a remote user may command the container of the invention into a locked state or an unlocked state.

Still referring to FIG. 8, controller 800 may be in direct or indirect communication with speaker 820. An audio amplifier may be in electrical communication with, and in line between, controller 800 and speaker 820 for the purpose of amplifying the audio signal or converting a digital signal to an analog audio signal for the purpose of driving speaker 820. In this manner, controller 800 may, upon execution of computer readable instructions stored in non-transitory computer readable media 810, cause certain sounds or audible signals to be emitted from speaker 820 as may be desired by the user and as described herein in the description of the functions of the electronic embodiment of the invention. In this manner alarm beeps or other audible signals may be utilized to indicate that the container of the invention has been commanded into a locked state, an unlocked state, or any other state. Also in this manner, an audible alarm may be sounded if the accelerometer 801 senses that the container of the invention has been moved, or if the optional geolocation receiver 802 receives GPS information indicating that the container of the invention has been moved to a new geographic location outside limits set by the user. This use of GPS location information to trigger an alarm may be termed "geo-fencing". A user may predetermine certain geographic limitations such that an alarm is sounded or an alarm signal is transmitted to a remote user through the wireless transceiver interface if the container of the invention has been moved outside, or moved into, predetermined geographic areas.

Still referring to FIG. 8, controller 800 may be directly or indirectly in electrical communication with several manual buttons making up pushbutton array 42 for the purpose of allowing a user to interface with the electronics of the container in order to command the container to perform certain functions, to enter certain states, or to enter personal identification information such as a Personal Identification Number (PIN) or other identifying indicia. For example, one or more buttons of pushbutton array 42 may be utilized to command the container into a powered on or powered off condition; to request status of the container, such as for example, status of the battery charge of the container; or to provide and unlock commands to controller 800.

Still referring to FIG. 8, an exterior surface of the container of the invention may also comprise lighting elements of any color, or that may be commanded to illuminate in one of a variety of colors that may be red, green, blue, yellow, orange or other colors as desired by a user, that are in electrical communication with controller 800 such that controller 800 is capable of commanding the lighting elements to individually be in an on state, an off state, a blinking state, or any other state, so as to provide visual indication of the status of the invention to a user. For example, controller 800 may be in electrical communication with lighting elements such as communication status lighting element 811, power status lighting element 812, or lock status lighting element 813 or any combination thereof. The lighting elements of the container are preferably, but not necessarily, light emitting diodes (LEDs), and may each have the capability to illuminate one color selected from a number of colors such as red, green, blue, yellow, orange, white or other colors, as commanded by controller 800 executing non-transitory computer readable instructions, and wherein specific lighting elements may be commanded to illuminate specific colors in certain situations, as commended by controller 800.

Still referring to FIG. 8, controller 800 may also be in electrical communication with at least one sensor for sensing the status of container. In an embodiment, the at least one sensor may comprise a plurality of sensors, such as, for example, latch state sensor 814 which produces a signal containing information indicating whether the latch of the invention is in an unlatched state or latched state, safe open/close sensor 816 which produces a signal containing information indicating whether the first portion and second portion of the invention are disposed in an open position or a closed position, and clip sense circuit 807, all of which may be in electrical communication with controller 800. The status of the buttons making up pushbutton array 42 may be stored in registers 818, which may be a part of non-transitory computer readable media 810.

Still referring to FIG. 8, battery 606 may be charged through an electrical port providing electrical connectivity to a battery charging source, the port being located on, in or through an exterior surface of the invention, and which may be USB port 815. Battery 606 may be in electrical communication with battery charger and power conditioning circuit 808, and may provide power to all the electrical and electronic components of the container directly, or through battery charger and power conditioning circuit 808.

Still referring to FIG. 8, controller 800 may be any electrical device or combination of electrical devices capable of executing computer readable instructions such a controller, microcontroller, microprocessor, programmable logic array, embedded firmware, virtual machine, combinational logic or any other electrical or electronic device or combination of devices known in the electrical arts as capable of executing computer readable instructions.

Figure 9:
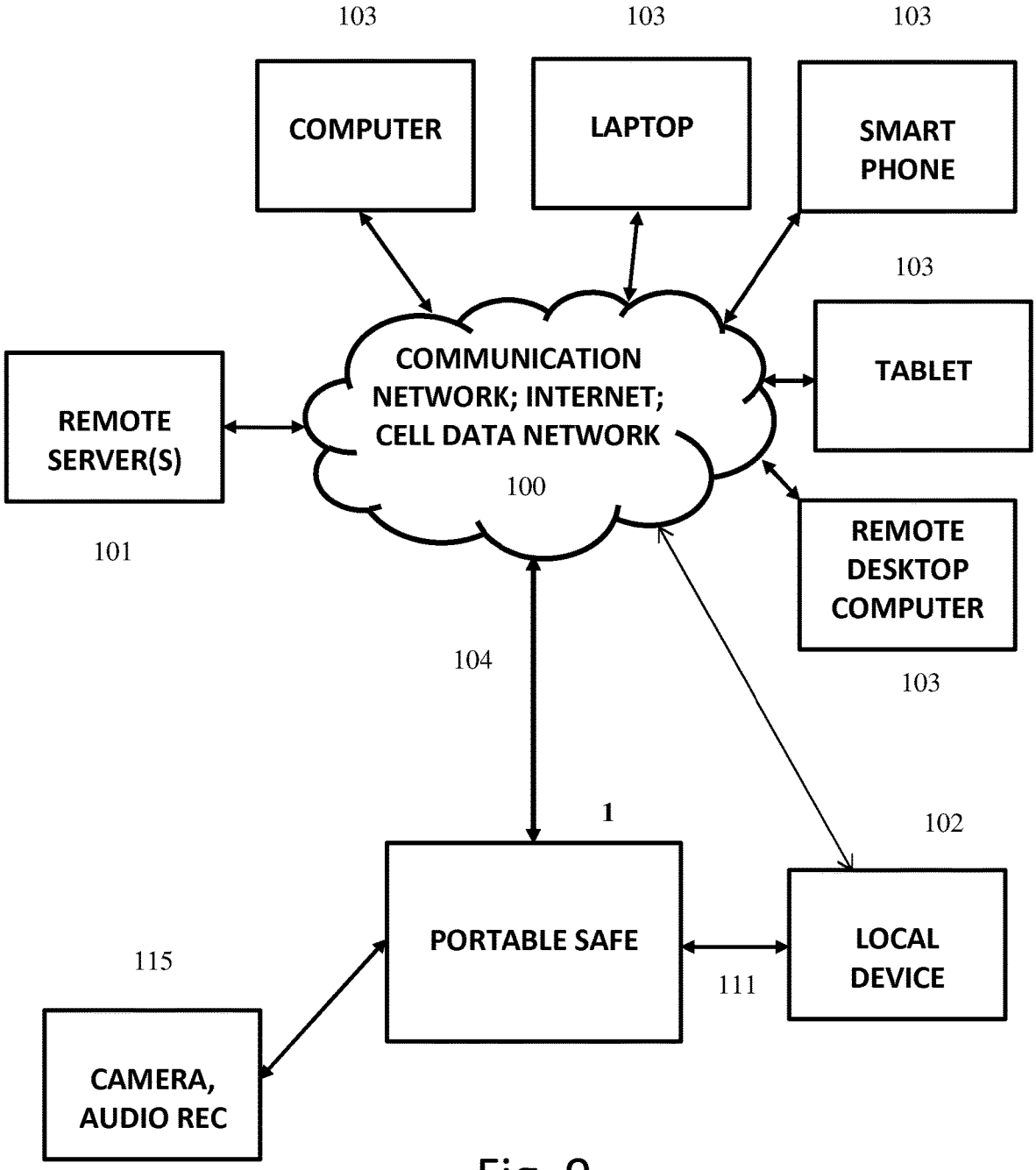
FIG. 9 depicts a system diagram of an embodiment of a container of the invention in wireless connectivity to a remote server, a remote user device such as a computer, laptop, cell phone, smartphone, tablet, remote desktop, or any other remote smart or computing device running portable safe application software; and also showing the portable safe of the invention and wireless or wired communication with a local device which may be a computer, laptop, cell phone, smartphone, tablet, key fob or any other smart computing device. The figure also depicts the wireless connection to a key fob.

Referring now to FIG. 9, a container of the invention 1 may be in wireless or wired communication 104 with local and/or remote computing devices 102 and/or 103, respectively, as described herein. The container 1 may be in communication with one or more local devices 102, which may be any electronic device, such as a key fob, smart phone, tablet, computer, or other device capable of running container application software and storing user authentication indicia. The container may be in communication with the local device 102 wirelessly through any known wireless communication link 111, including but not limited to Wi-Fi, Bluetooth, RFID, NFC, or any RF communication link, or infrared optical communication links. The portable safe may also be in wired communication with one or more local devices 102 via a USB port or any other electrical connection. The local device 102 may comprise a controller for executing instructions in communication with a transceiver for communicating with processor 800 of a container of the invention, and may comprise non-volatile computer readable instructions in non-volatile computer readable media for storing instructions such that the local device processor may execute portable safe application software to communicate with the portable safe 1 and to command the portable safe to carry out the functions described herein. Likewise, container 1 may also be in communication with one or more remote devices 103 which may be any number or combination of computers, smart phones, tablet computers, laptop computers, desktop computers, smart phones or any other device capable of running and executing portable safe application software and storing user authentication indicia. Such devices may be used as remote monitors. Communication between the container 1 and the remote devices 103 may be wired or wireless through the remote user data interface. In the case of wireless communication the remote devices and container may communicate via GSM, CDMA or other cellular radio based communication links, RF analog radio data links, the Internet, IEEE 802.11 wireless LAN, other wireless LANS or any other communication network, and in any combination thereof. In this manner the container of the invention 1 may be controlled, monitored or tracked geographically remotely as described herein, and remote users may command the portable safe into locked or unlocked modes, may receive alerts and alarm information as described herein and may receive other status information as desired by the remote user. The portable safe may also be in wireless communication with a remote server 101 via the world wide web 100 as shown in the figure. In a preferred embodiment all portable safe configuration information, status inquiries, and notifications may be communicated via the world wide web to a remote server 101, where it may be made available to a user via, for example, a web site or application running on a remote device such as a cell phone software application.

Figure 18:
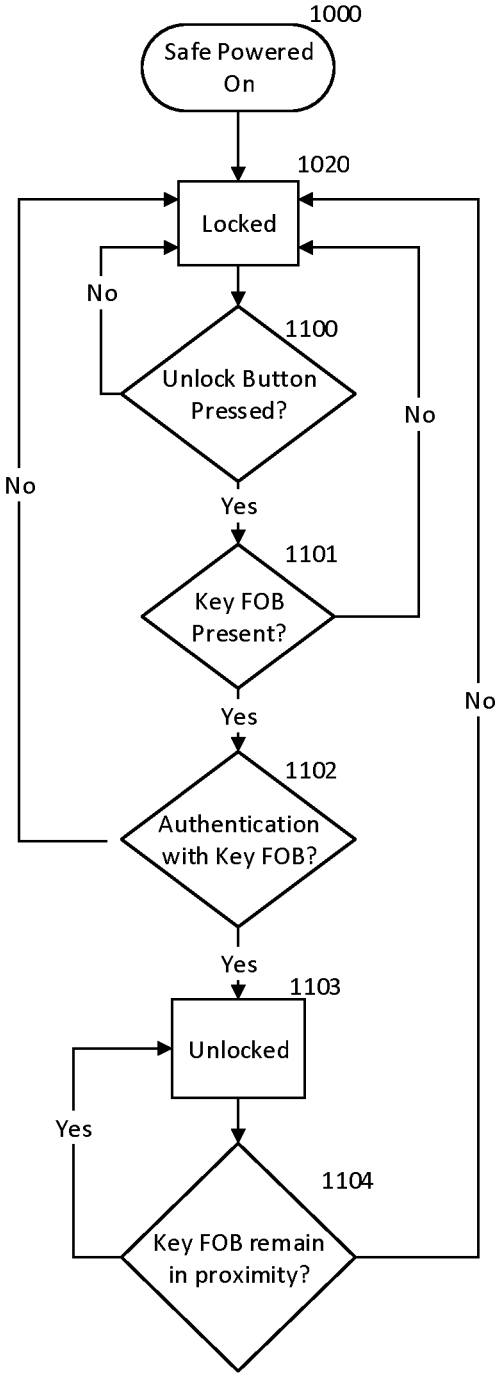
FIG. 18 depicts a flow diagram for a key fob embodiment of the invention.

Still referring to FIG. 9, in an embodiment, local device 102 may be a key fob. Such a key fob may be carried by a user, for example on a key chain or in a user's pocket. The key fob may comprise wireless communication components such as Radio Frequency Identification (RFID) components, or other RF, optical, or other wireless communication means as described herein. In the key fob embodiment, the container communicates wirelessly and preferably automatically with the user when the user comes into proximity of the container 1 such that the electromechanical latch is commanded by the controller to lock the container when the key fob is not in proximity to the container, and to unlock the container when the key fob is in proximity to the container. "Proximity" may be any distance desired by a user and within the communication capability of the wireless communication components comprising the key fob and the container. Typically, in a key fob embodiment utilizing RF components in both the key fob and the container in wireless communication, the operational distance may be predetermined by selecting the type of RF communication link, such as for example RFID; selection of either passive or active RFID tags within the key fob; type of antennas employed; receiver sensitivity; transmit power and operating frequency. These components may be selected, for example, to provide communication when the key fob is within three feet, five feet, ten feet, twenty feet or greater. The user may be presented with a means for programming the transmit power, for example by inputting data into keypad 42, such that a desired operating range is achieved. For an example in which the container is to be carried on a person such as a personal holster, the operating distance may be on the order of one foot or less. In an example in which the container is carried in a vehicle, for example between a front seat and vehicle console, a user may desire that the container be unlocked automatically via key fob communication when the key fob is within close proximity to the vehicle, for example an operating distance of ten feet or less. The key fob may comprise a switch for enabling or disabling communication with the container. A flow diagram for a key fob embodiment of the invention is depicted in FIG. 18, described below.

Still referring to FIG. 9, the invention may comprise container application software, which may include non-volatile computer readable instructions, and which may be downloaded to a local device 102 or a remote computing device 103 from a remote server 101 through, for example the world wide web 100, from online application stores, or from or through any other source, and may reside in a local electronic device 102 non transitory computer readable media. The container application software may be operable to provide a user interface for the entering and the transmitting of commands to a container of the invention 1 via a remote user data interface and may contain instructions allowing a user to establish, store and execute schedules for events such as scheduling locking and unlocking of the portable safe, GPS tracking and geolocation information storage, monitoring container battery status, and the like. The container application software may contain instructions for carrying out the methods and steps described and taught herein.

Still referring to FIG. 9, the container 1 may further comprise an external camera or audio recording or transmitting device 115 in wireless communication with the transceiver 806. When the open/close sensor 816, which is in electrical communication with controller 800, determines that the retractable cover has been retracted into an open position, the controller may execute non-transitory computer executable instructions to command camera or audio recording or transmitting devices 115 to an on state. In this manner, local video or audio information, or both, may be automatically recorded and transmitted to a remote location when the retractable cover is retracted, exposing a firearm or other valuable item for immediate use.

Figure 10:
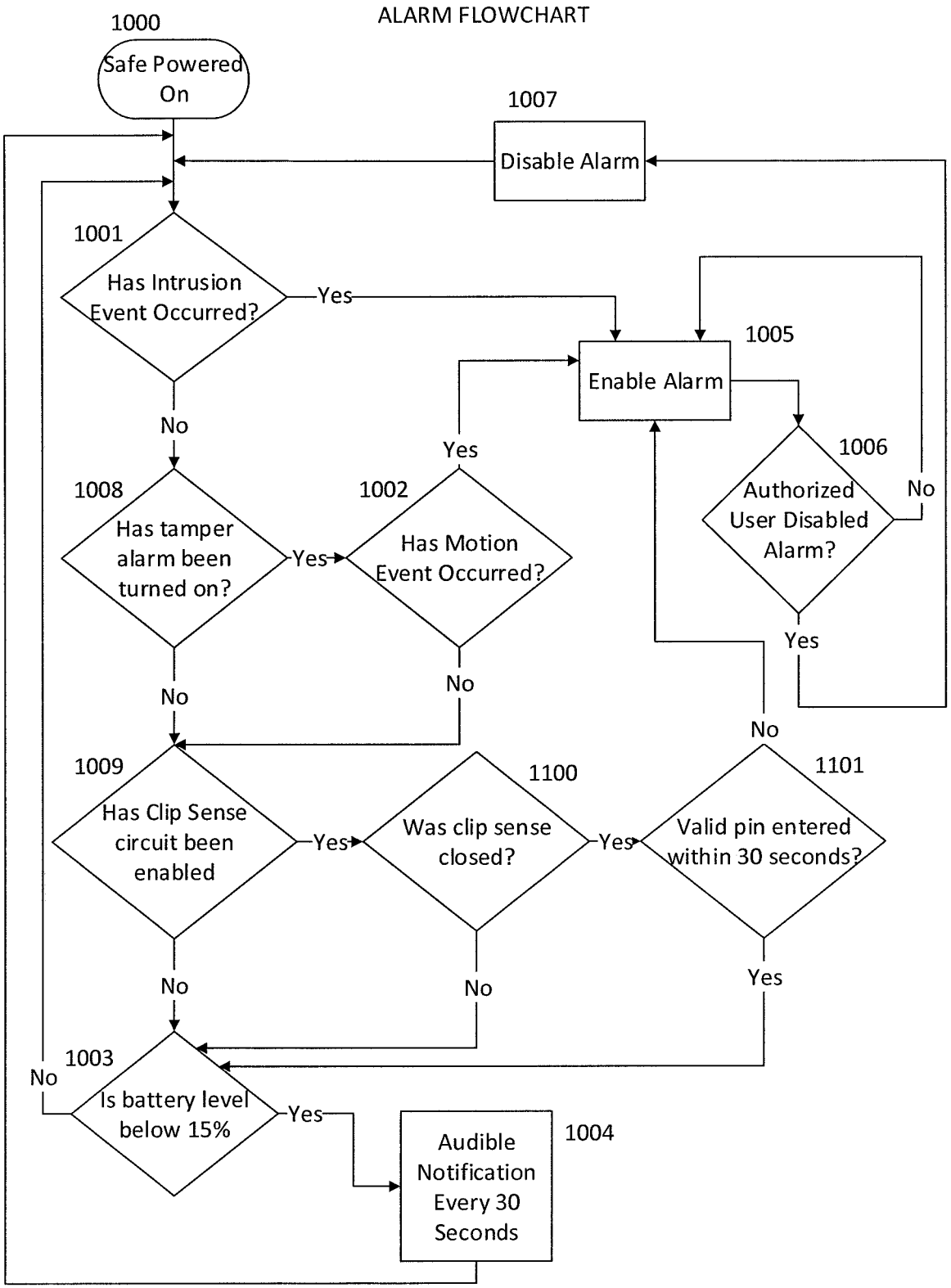
FIG. 10 depicts a flow diagram of one embodiment of an alarm function of an electronic embodiment of the container of the invention.

Referring now to FIG. 10, a flow diagram of one embodiment of an alarm function of an electronic embodiment of the container of the invention is depicted. In a first step 1000, the container of the invention may be in a constant ON state, or may be placed into a powered-on condition by operation of a manual pushbutton 42 (depicted in FIG. 8). Once having powered on, controller 800 may monitor the state of sensors placed within the container to determine whether an intrusion event, such as, for example, unauthorized opening of the container which may be defined as opening of the safe without a proper PIN code having been received, has occurred in step 1001. If it is determined that an intrusion event has occurred an alarm may be operated, step 1005. The alarm may be an audible alarm such as playing a sound through speaker 820 (depicted in FIG. 8), a visible alarm in the form of lighting lights such as LED lights 811-813 (depicted in FIG. 8) which may be placed on any surface of the container of the invention, the transmission of a signal to a remote entity through the remote user data interface of the container, or any combination of these alarms. The transmission of a signal containing alarm information to a remote user through the remote user data interface may be in the form of a cellular text message sent to a predetermined cellular telephone number or other entity capable of receiving a cellular text message. Once the alarm has been operated in step 1005, the safe monitors whether the alarm has been disabled 1005. An authorized user may disable the alarm 1007 by entering a PIN code on pushbuttons 42, causing the container of the invention to be placed into a no-alarm state, whereupon it will return to monitoring whether an intrusion has occurred 1001. If an authorized user has not disabled the alarm, the alarm will continue to operate.

Still referring to FIG. 10, if no intrusion event has occurred 1001, the container of the invention senses whether the tamper alarm has been turned on, step 1008. The tamper alarm may be turned on remotely by receiving signals through wireless interface 806 (depicted in FIG. 24) or may be set by a user by manual operation of pushbuttons 42. If the tamper alarm has been turned on 1008, the safe may interrogate or receive signals from the one or more accelerometers of the invention 801 (depicted in FIG. 8). If the one or more accelerometer signals indicate that a motion event has occurred 1002, such as the at least one accelerometers sensing that the safe has been rotated beyond a predetermined limit, or the accelerometers sensing that the safe has been moved continuously for programmable minimum period of time such as, for example, five seconds, the alarm of the invention may be enabled 1005 and will remain enabled until an authorized user disables the alarm as above described.

Still referring to FIG. 10, if the tamper alarm has not been turned on 1008, or, if it has been turned on but no motion event has occurred 1002, the container of the invention senses whether fast access mode has been enabled 1009. Controller 800 may read the state of registers in non-transitory computer readable media 810 in order to determine whether fast access mode, in which the lock is in an unlocked state and the container has been clipped onto a structure such that the clip sense circuit is open, has been commanded by a user operating pushbuttons 42 and entering, for example, a PIN code and command, or by a remote user transmitting wireless signals to the safe through the remote user data interface. If fast access mode has been enabled 1009, the container may sense whether the clip circuit is closed, indicating that the safe has not been placed on a structure such as, for example, the pants belt of a user.

If the clip circuit has not been closed 1100, indicating that the safe is located on a receiving structure such as the pants belt of a user, controller 800 may execute a timer for a predetermined programmable period of time 1101, which may be, for example, thirty seconds, and if a valid PIN code is not entered into the safe through pushbuttons 42 prior to the expiration of the predetermined programmable period of time, alarm 1005 may be operated and may be disabled as above described.

Still referring to FIG. 10, if fast access mode has not been enabled, the level of charge of battery 606 is ascertained by controller 800 reading signals from the battery charger and power conditioning circuit 808 (depicted in FIG. 8) to determine if the battery charge level is below a predetermined low-charge threshold, such as, for example, 15% of full charge. If the battery level is below a predetermined low-charge threshold an audible notification will be commanded by controller 800 through speaker 820 (depicted in FIG. 8), for example an audible signal made every 30 seconds such as a beep, until the battery level is returned to a level that is greater than a predetermined low-charge threshold as determined by battery charger and power conditioning circuit 808. A predetermined low-charge threshold and a pre-determined medium-charge threshold may each be stored in non-transitory computer readable media 810 and may therefore be readable by controller 800.

Figure 11:
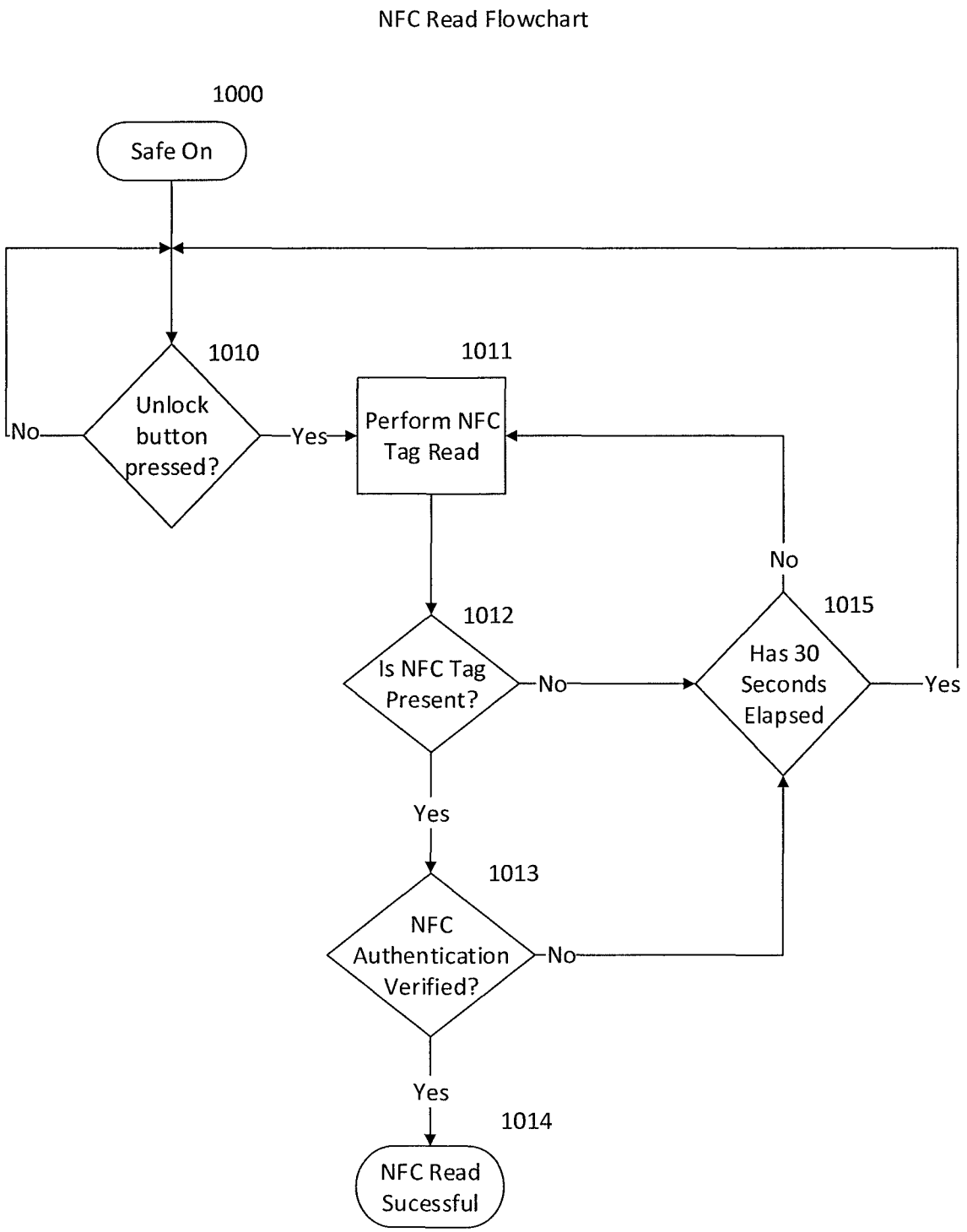
FIG. 11 depicts a flow diagram of one embodiment of a Near Field Communication (NFC) read function of an electronic embodiment of the container of the invention.

Referring now to FIG. 11, a flow diagram of an alternate embodiment of the safe of the invention which utilizes an optional Near Field Communication (NFC) read function of an electronic embodiment of the container of the invention is described. In a first step 1000, the container of the invention may be placed into a powered-on condition as above described. Once having powered on, controller 800 or other circuitry may monitor the state of a push button of button array 42 (depicted in FIG. 8) to determine whether a user has commanded the safe to unlock, step 1010. If a user has commanded unlock through push button 42, the controller 800 monitors a near field communication transceiver in communication with controller 800 in order to ascertain whether a near field communication tag has been read 1011. If it is determined that a near field communication tag is present 1012, controller 800 executes computer readable instructions to determine whether the near field communication tag is an authenticated tag of an authorized user, step 1013. An authenticated near field communication tag is one that has been predetermined as belonging to an authorized user of the container of the invention, and for which a code has been stored in non-transitory computer readable media 810. If it is determined by controller 800 reading non transitory computer readable media 810 and executing computer readable instructions that the near field communications tag is that of an authorized user, the controller generates and stores in non-transitory computer readable media 810 a near field communication read successful message 1014. If it is determined by controller 800 executing computer readable instructions that near field communications tag is not that of an authorized user 1013, it determines whether a predetermined, programmable period of time, such as 30 seconds, has elapsed since the near field communication tag read by the near field communication transceiver in step 1015. If the predetermined, programmable period of time has not elapsed, controller 800 returns to step 1011 and performs another near field communication tag read. If the predetermined, programmable period of time has elapsed, controller 800 commands the container of the invention to return to a state wherein it reads whether a push button of button array 42 has been pressed to command unlock, step 1010.

Figure 12:
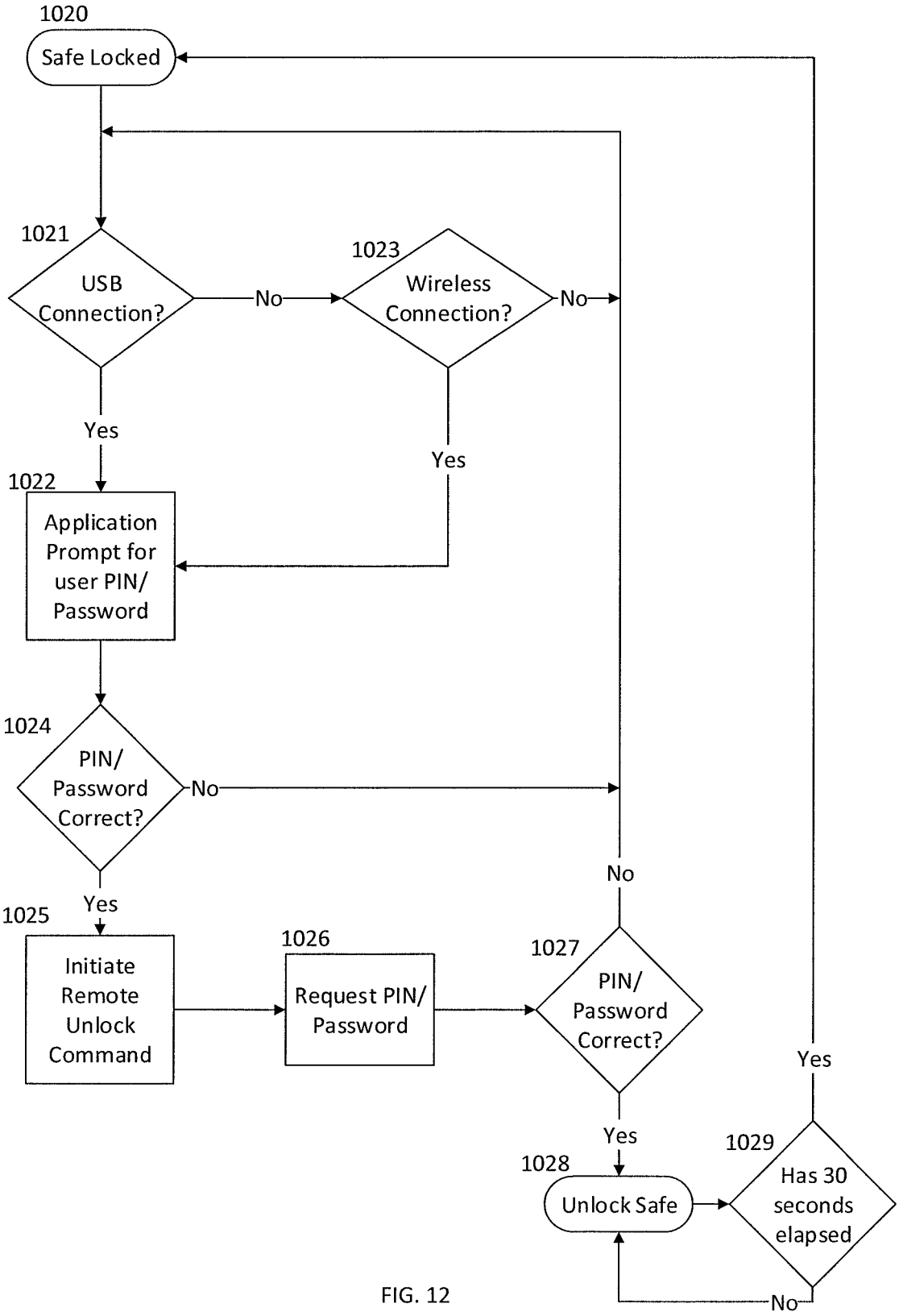
FIG. 12 depicts a flow diagram of one embodiment of a remote unlock function of an electronic embodiment of the container of the invention.

Referring now to FIG. 12, a flow diagram of one embodiment of a remote unlock function of an electronic embodiment of the container of the invention is depicted. In an initial state 1020, the lock of the container of the invention is in a locked condition. In a next step 1021, controller 800 reads the state of Universal Serial Bus (USB) port 815 (depicted in FIG. 8) to determine whether there is an active USB connection to a remote device. If there is no active USB connection to a remote device, controller 800 executes non-transitory computer readable instructions to determine in step 1023 whether there is an active wireless connection through wireless transceiver 806 (depicted in FIG. 8) to a remote device such as a laptop computer, smart phone, tablet or tablet computer, smart watch, Internet connection or other wireless connection to a remote device. If it is determined that there is an active USB connection or a wireless connection to a remote device, controller 800 may execute computer readable instructions in to communicate with the connected device and to thereby receive a remote device signal, whether the remote device is connected via USB or wirelessly, whereupon a user using the connected device may be prompted to enter a personal identification number, or PIN, password, or other identifying indicia which may be operative to identify the user and to allow controller 800 to execute instructions in order to determine whether the user is an authorized user. The user may have already provided identifying indicia such as a personal identification number (PIN), password or the like that has been stored in non-transitory computer readable media 810 to facilitate controller 800's execution of instructions to identify whether the user is an authorized user 1024. If the user is determined to be an authorized user by the entry of a correct PIN or password 1024, controller 800 will execute instructions to initiate the remote unlock command 1025 and will again require the remote user to enter a personal identification number, password, or other identifying indicia 1026. If the user again enters correct authenticating identifying indicia (i.e. for the second time) 1027, controller 800 will execute instructions unlocking the electromechanical lock mechanism of the container as hereinbefore described 1028, thus placing the container of the invention in an unlocked condition so that a user may manipulate latch thumb plate 251 as hereinbefore described to open the container 1028 (in other words, the safe is placed into fast access mode). Requiring a user to enter authenticating identifying indicia twice is an optional safety feature that is intended to prevent accidental unlocking of the container by the user. This could happen, for instance, if a user accidentally swipes an "unlock" command on their cell phone touch screen while the container software application is running on the cell phone and the cell phone is in wireless communication with the container of the invention through the remote user data interface. The safe will remain unlocked 1028 for a predetermined, programmable period of time, such as, for example, thirty seconds, and then will return to the locked condition 1029. If the identifying indicia such as personal information number or password are not correct, step 1027, the container of the invention will remain in the locked condition and the process will start again 1021. Thus a remote user may remotely unlock the safe for a predetermined, programmable period of time, such as, for example, thirty seconds.

Figure 13:
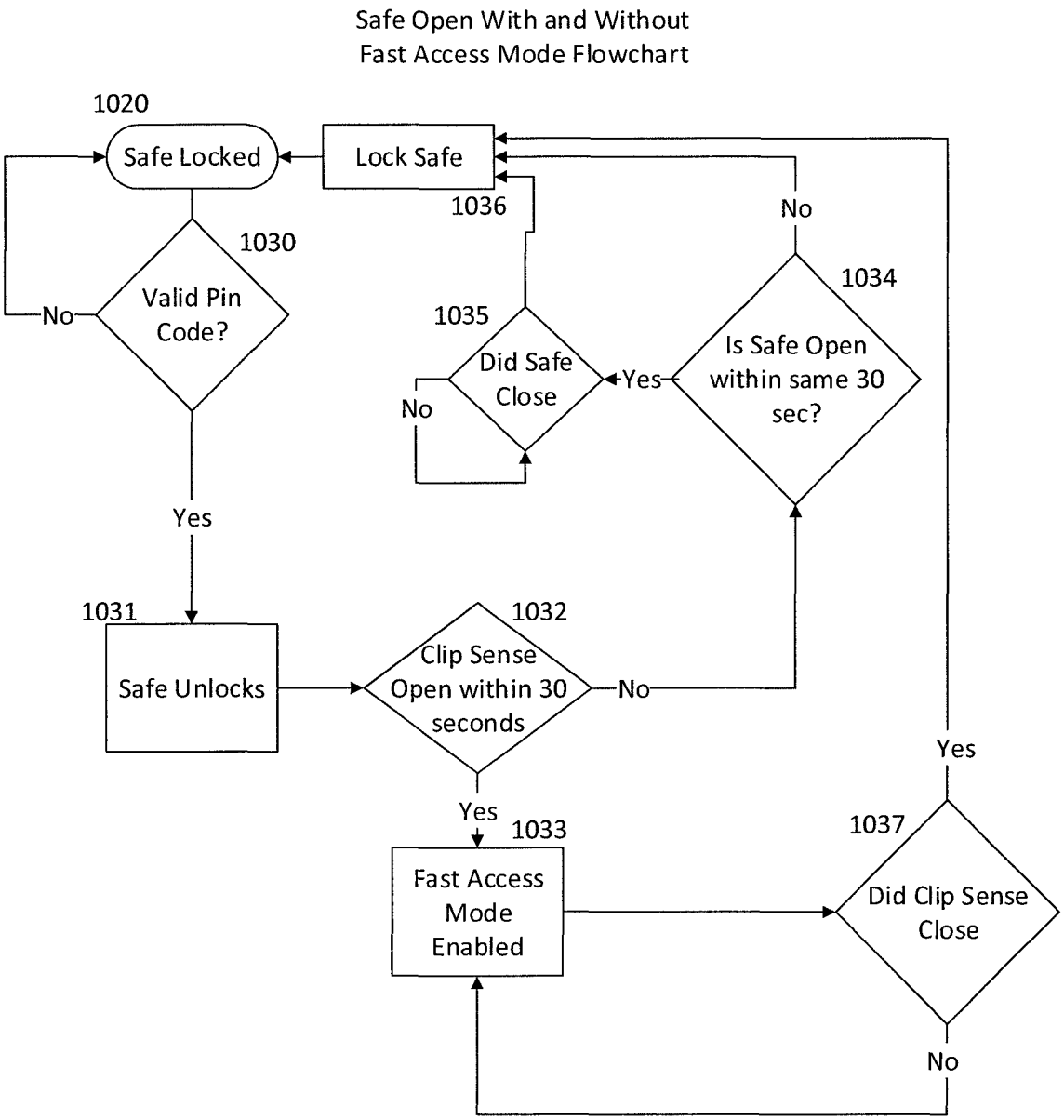
FIG. 13 depicts a flow diagram of one embodiment of an open function of an electronic embodiment of the container of the invention.

Referring now to FIG. 13, a flow diagram of one embodiment of an optional "open" function of an electronic embodiment of the container of the invention is depicted, in which the container of the invention may be opened in either fast access mode, or non-fast access mode. In this embodiment of the open function, the container may begin in a locked condition 1020. The container of the invention may be unlocked by a user entering a PIN code through pushbutton array 42 (depicted in FIG. 8) in step 1030. If controller 800 determines that the PIN code is correct 1030, controller 800 may command the electromechanical latch to an unlocked state, thus unlocking the container 1031 so that it may be opened by operation of the latch thumb plate 251. If controller 800 determines that the PIN code is incorrect 1030, the safe remains locked 1020. After step 1031, controller 800 may continue to execute non transitory computer readable instructions to determine whether the clip sense circuit has opened within a predetermined programmable time, for example thirty seconds, step 1032. If the clip circuit has opened with a predetermined programmable time, for example thirty seconds, for example by placing the safe onto a pants belt by engaging clip 261 onto a belt, fast access mode is enabled 1033 in which the safe is unlocked and may be quickly opened by depressing mechanical release 17. Controller 800 may continue to monitor the clip sense circuit 1037. If the clip sense circuit remains open 1037, fast access mode continues to remain enabled. If, however, clip sense circuit closes 1037, controller 800 commands the electromechanical lock of the invention into a locked state 1036, 1020, locking the safe, and the process can begin again by user entering a PIN code 1030.

Still referring to FIG. 13, if the clip sense circuit has not opened in a predetermined programmable time, for example thirty seconds, step 1032, controller 800 executes non transitory computer readable instructions to determine whether the container has been opened with the predetermined programmable time, 1034. If it has, controller 800 executes non transitory computer readable instructions to determine whether the safe has been closed 1035. Once the container has been closed 1035, controller 800 executes non transitory computer readable instructions to place the electromechanical lock in to a locked state 1036, 1020, locking the container, and the process can begin again by user entering a PIN code 1030. If the container is not opened within the predetermined programmable time, 1034, controller 800 executes non transitory computer readable instructions to place the electromechanical latch in to a locked state 1036, 1020, locking the container, and the process can begin again by user entering a PIN code 1030.

Figure 14:
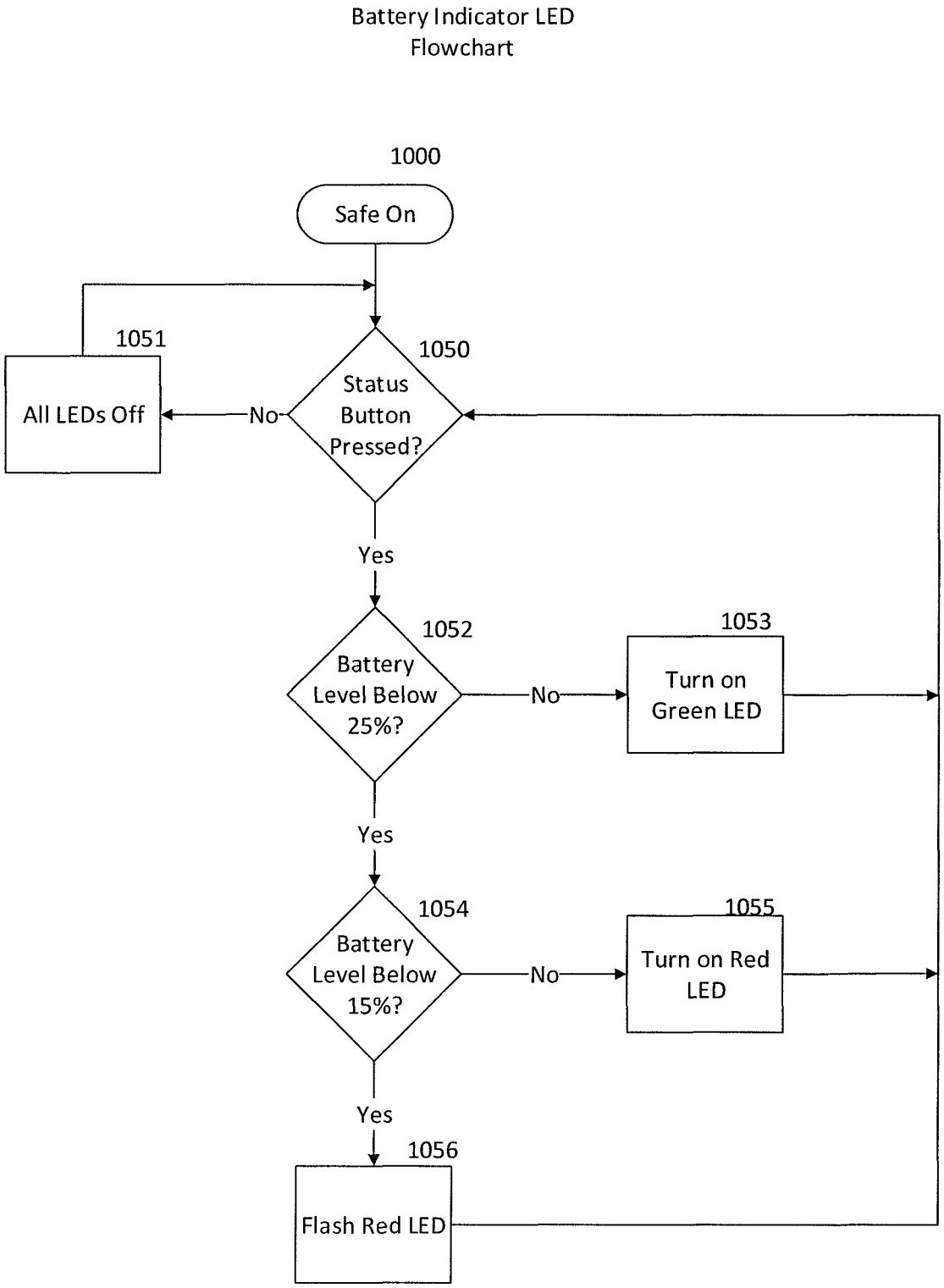
FIG. 14 depicts a flow diagram of one embodiment of a battery charge level indicator function of an electronic embodiment of the container of the invention.

Referring now to FIG. 14, a flow diagram of one embodiment of a battery charge indicator function of an electronic embodiment of the container of the invention is depicted. In an initial step 1000, the container of the invention is powered on. Controller 800 may execute computer readable instructions to make a determination whether a status button, which may be, for example a button of pushbutton array 42, has been pressed by a user. If a status button has not been pressed, controller 800 will execute instructions to cause power status indicator light 812 to remain in an off, non-illuminated, state in step 1051 and controller 800 will continue to monitor the state of pushbutton array 42 in order to ascertain whether a status button has been pressed. If a status button has been pressed by the user 1050, controller 800 will execute instructions to receive a signal containing battery charge level information from battery charger and power conditioning circuitry 808 and to make a determination whether the battery charge level of battery 606 is below a predetermined medium-charge threshold, for example, 25% of full charge in step 1052. If, in step 1052, it is determined by controller 800 that the battery level is below a predetermined medium-charge threshold, controller 800 will then execute instructions to make a determination as to whether the battery level is below a predetermined low-charge threshold, step 1054. If the battery level is below a predetermined low-charge threshold, controller 800 may execute instructions to illuminate a red light, such as power status indicator light 812 operating in red mode, for example to flash, in step 1055, indicating that a low battery level condition exists. If, in step 1052, it is determined that the battery level is not below a predetermined medium-charge threshold, controller 800 will execute instructions to illuminate a green light, such as power status indicator light 812 operating in green mode, in step 1053. If, in step 1054 it is determined that the battery level is below a predetermined low-charge threshold, controller 800 may execute instructions turning on a red light. The lights referred to in this series of steps regarding battery indication are preferably visible on an exterior surface of the container of the invention, or may transmit light through a transparent window allowing a user to view the indicated status without needing to open the container or to unlock the container. In an embodiment, controller 800 will only illuminate the lighting elements of the invention if a user has depressed one or more pushbuttons of pushbutton array 42, and such illumination may be for a predetermined length of time programmable by storing a time value in computer readable media 810 which is read by controller 800 and used to determine the length of time for which it is desired that the lighting elements be illuminated, indicating status of the container. In this manner the container may be operated discretely because the lighting elements will only illuminate upon command by a user, and may only illuminate for a predetermined length of time.

Figure 15:
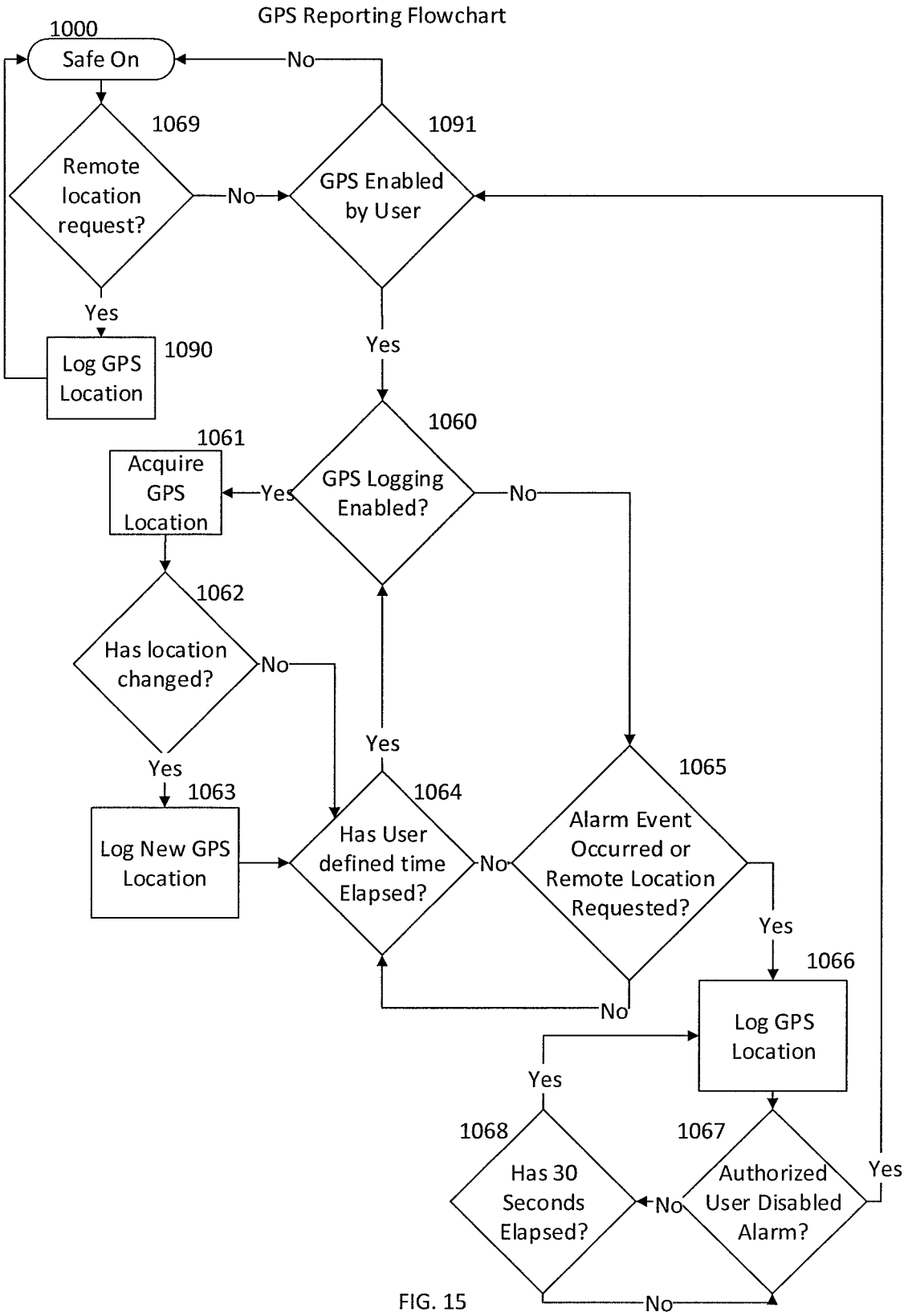
FIG. 15 depicts a flow diagram of one embodiment of a geolocation function of an electronic embodiment of the container of the invention.

Referring now to FIG. 15, a flow diagram of one embodiment of a GPS geo-locating and location logging function of an electronic embodiment of the container of the invention is depicted. In an initial step 1000 the container of the invention is in an on condition. Controller 800 may execute instructions 1069 to determine whether a remote user has requested container geolocation information 1069. If a remote user has requested geolocation information, controller 800 may execute instruction to read geolocation information from GPS receiver 802 and store the geolocation information in memory 1090 such as non-transitory computer readable media 810. If a remote user has not requested geolocation information 1069, controller 800 determines whether GPS has been enabled by a user 1091. If it has, controller 800 then may determine whether GPS logging has been enabled 1060. If GPS has not been enabled by a user 1091, controller 800 continues to monitor for a remote location request 1069.

If GPS has been enabled by a user 1091, and if GPS logging has been enabled by a user 1060, the GPS receiver 802 will acquire GPS location information 1061. If the location of the container has changed 1062, for example beyond a predetermined limit, the new geolocation information is logged into non transitory computer readable media 1063. If a user defined time limit has elapsed 1064, controller 800 checks to see if GPS logging is enabled 1060 and the process repeats if it has. If GPS logging has not been enabled 1060, and if an alarm event has not occurred or if no remote location request has been received 1065, controller 800 checks to see if a user defined time limit has elapsed 1064.

Still referring to FIG. 15, if GPS logging has been enabled by a user 1060, GPS tracker transceiver 802 (depicted in FIG. 8) will acquire GPS satellite communication and will provide a signal corresponding to the geographic location of the container, 1061. Controller 800 will store the location information from the signal corresponding to the geographic location of the container in non-transitory computer readable non transitory computer readable media 810 and may compare the geolocation information to previously stored geolocation information in step 1062 so as to make a determination as to whether the container of the invention has been moved to a new location 1063. A user may, through the wireless interface or USB interface and by using an external device such as a laptop, tablet, cell phone, smart watch or any other device running container application software, program geographic limitations or boundaries into the container for storage in non-transitory computer readable media 810 so that the user may define custom geographic territorial limits which would result in a notification, which could be audible, visual, or message such as email, instant message, SMS text message or the like in those instances in which the container has been moved beyond a predetermined geographic limits. If the geographic location of the container has changed, for example beyond a predetermined geographic limit, step 1062, the new GPS geolocation information is received by controller 800 and stored in a non-transitory computer readable media 810. If the geolocation of the container has not changed, for example beyond a predetermined geographic limit, step 1062, controller 800 executes instructions to determine whether 30 minutes has elapsed since the last geolocation reading, step 1064. If 30 minutes or more has elapsed, the cycle starts again and if GPS tracking remains enabled 1060, a new GPS geolocation signal is acquired step 1061. If 30 minutes has not elapsed since the last GPS geolocation reading, step 1064, the controller 800 executes instructions to determine whether any alarm event has occurred or whether a remote user has requested geolocation information, for instance, through the RF wireless transceiver or optical transceiver 806, step 1065. If no alarm event has occurred and if no remote location request has been made by a remote user, the system continues to monitor whether 30 minutes has elapsed since the last geolocation reading. If an alarm event has occurred or if a remote user has requested location information, step 1065, GPS location information of the container is received by controller 800 and stored in non-transitory computer readable media 810. Next, controller 800 executes instructions to determine whether an authorized user has disabled the alarm, step 1067 if an authorized user has not disabled the alarm, controller 800 determines whether 30 seconds has elapsed 1068. If more than 30 seconds has elapsed the system logs GPS location data in step 1066 by causing controller 800 to execute instructions storing the GPS location data in non-transitory computer readable media 810. If 30 seconds has not elapsed, controller 800 continues to monitor whether an authorized user has disabled the alarm 1067. If, in step 1067, an authorized user has disabled the alarm, the system remains in the on state and controller 800 continues to monitor whether GPS tracking has been enabled and the method returns to step 1060.

Figure 16:
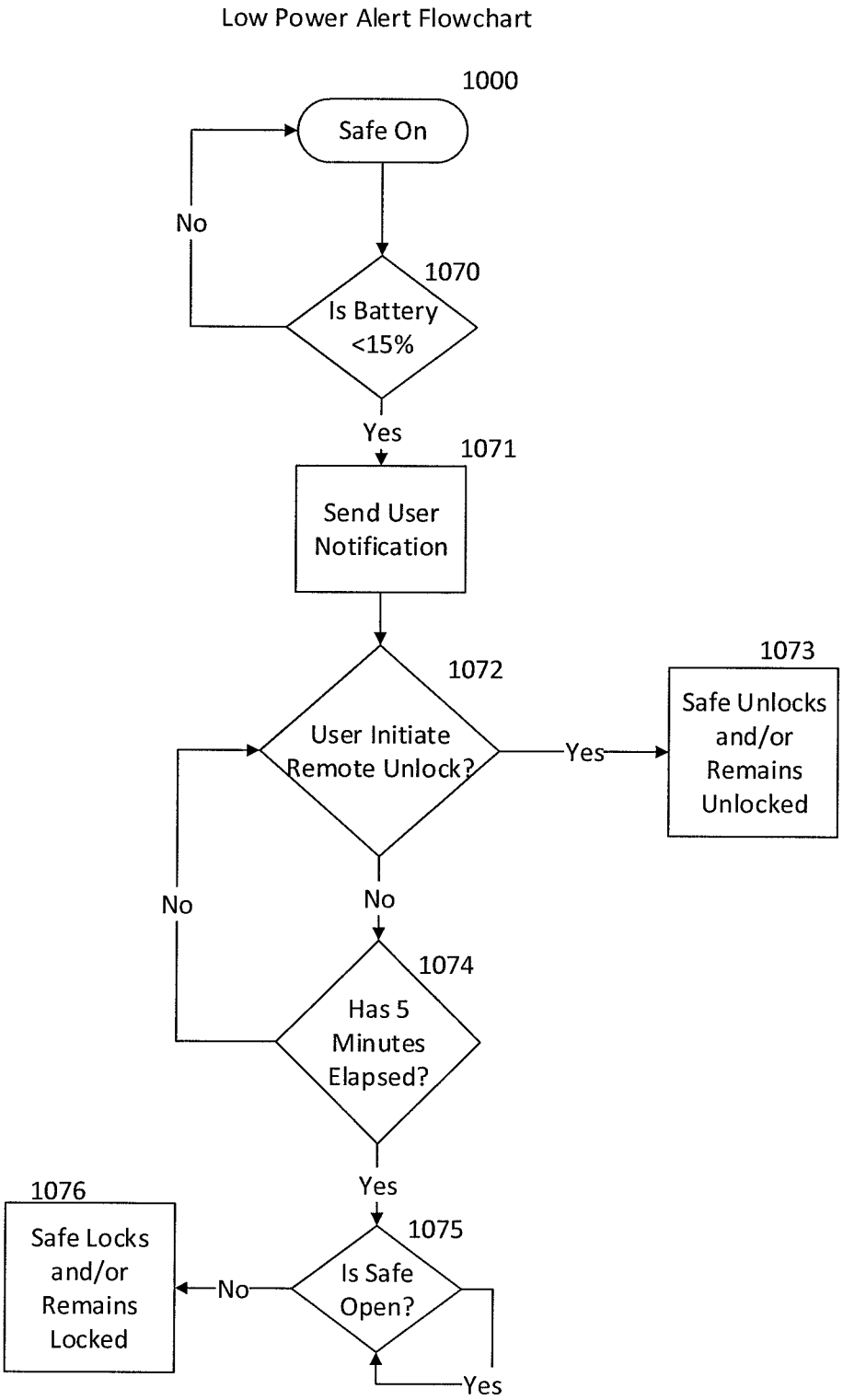
FIG. 16 depicts an electrical block diagram of a low battery charge level alert function of an electronic embodiment of the container of the invention.

Referring now to FIG. 16, starting from a powered-on condition 1000, controller 800 will execute instructions to receive a signal from battery charger and power conditioning circuitry 808 and to make a determination whether the battery charge level of battery 606 is below a predetermined low-charge threshold, which may be for example 15% of full charge, in step 1070. If the battery charge level is below the predetermined low-charge threshold, a BATTERY CHARGE LOW or equivalent message will be transmitted to a remote user through wireless transceiver 806, step 1071. If a remote user has initiated a Remote Unlock command to the container through wireless transceiver 806 or through USB interface 815 in step 1072, controller 800 will command the electromechanical lock into an unlocked state and the safe will remain unlocked 1073. If a remote user has not initiated a Remote Unlock command 1072, controller 800 will, for a programmable period of time, for example five minutes, continue to monitor for a Remote Unlock command 1072. If, after the programmable period of time, no Remote Unlock command has been received, controller 800 will command the electromechanical lock into an locked state if the safe is closed, causing the safe to be in a locked condition.

Figure 17:
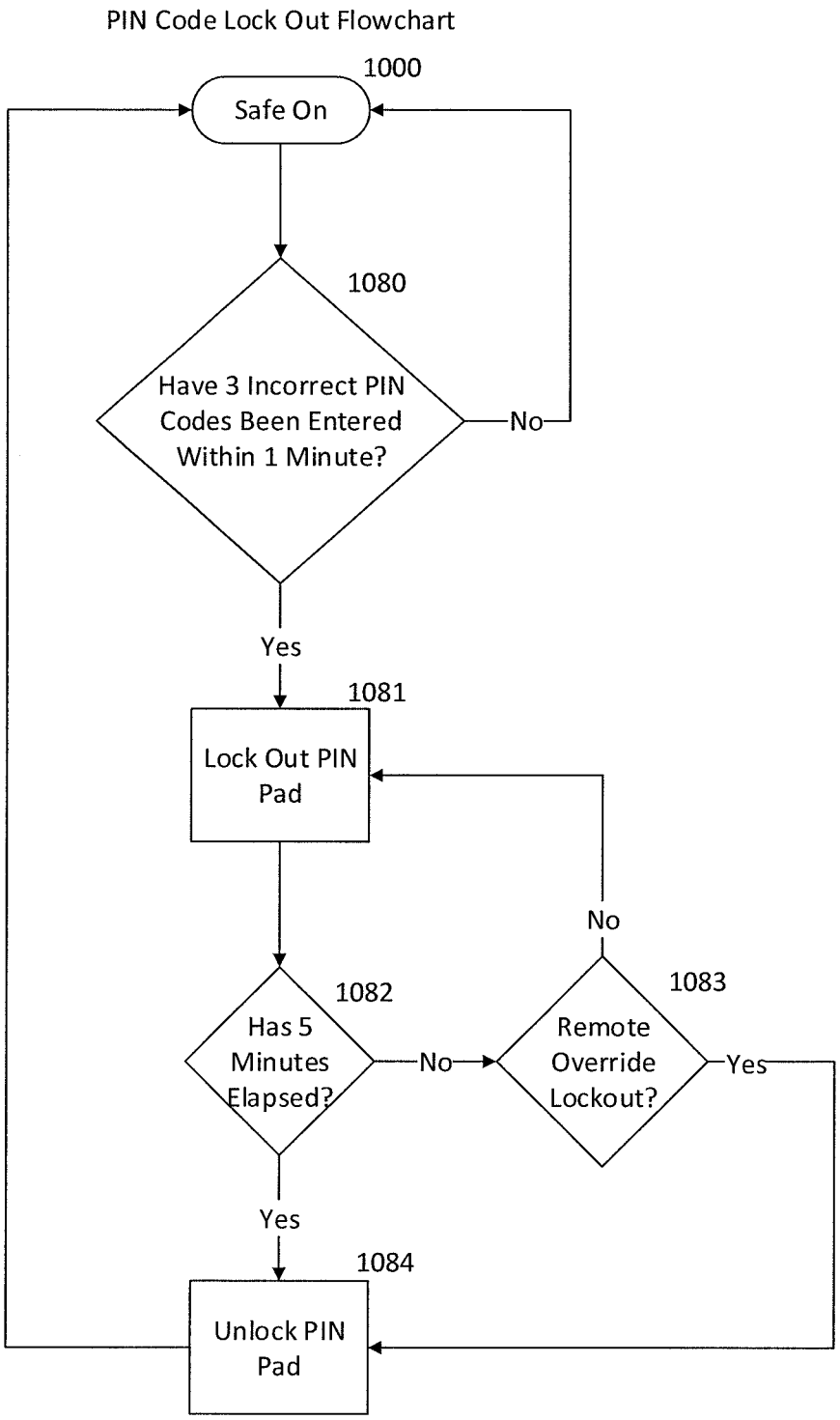
FIG. 17 depicts a flow diagram of one embodiment of a PIN code lockout function of an electronic embodiment of the container of the invention.

Referring now to FIG. 17, a PIN code lockout flow diagram is presented. In an initial step the container is power to an on state 1000. Once a user begins entering PIN codes into pushbutton array 42 or by any other means, controller 800 monitors to check if three incorrect PIN codes have been entered within a programmable period of time, for example one minute, step 1080. If they have, the PIN pad will be disabled 1081 and will not accept entry of PIN codes for a programmable PIN code lockout period 1082 which may be, for example, five minutes. A remote user may remotely, through wireless transceiver 806, transmit commands causing the lockout period to be terminated 1083 and unlocking, or re-enabling, PIN pad 1084 and returning the container to a state in which a local user may again attempt to enter a PIN code through the PIN pad.

In any step of the invention described herein, the functions described may be carried out by controller 800 executing non-transitory computer readable and executable instructions stored in computer readable media 810. Such instructions may also be carried out by the various circuit elements that comprise electronics assembly 610 or any circuit elements connected thereto. Thus these functions are not limited to being carried out by controller 800, and the claims of the patent should be thus interpreted. The steps described are optional, and need not be present in all embodiments of the invention. They may be present in any combination.

Referring now to FIG. 18, a flow diagram for a key fob embodiment of the invention is depicted. Initially, the container of the invention may be powered on in step 1000, and may persist in a locked state 1020 upon power up. The key fob may comprise a processor in communication with an RF transmitter, or may comprise an RFID tag. The key fob RF transmitter or RFID tag may be in communication with the RF transceiver of the container, such that the processor 800 of the container may set a register or store to non-volatile computer readable media 810 a KEY FOB PRESENT code to indicate that the key fob is present. When it is desired to unlock the container, an unlock button 42 on the container may be depressed, step 1100. If the key fob is determined to be present as set forth above, step 1101, a code received from the key RF link or RFID tag is received by the container RF receiver and compared with the authentic PIN code stored in non-volatile computer readable media 810 in step 1102. If the code is authenticated, the container is unlocked by an electromechanical latch, step 1103. The processor 800 will instruct the electromechanical latch to remain in an unlocked position for as long as the key fob remains in proximity 1104. However, when the key fob is physically separated by a distance such that the RF link between the key fob and RF transceiver 806 is broken, or when the RFID tag in the key fob no longer is able to communicate with RF transceiver, the KEY FOB PRESENT code set by processor 800 is changed by processor 800 to indicate that the key fob is no longer present, and processor 800 commands the electromechanical latch to lock the container so that it cannot be manually opened.

In any of the embodiments, the functions depicted in FIGS. 10-18 are optional functions, in any combination, in any embodiment.

INDUSTRIAL APPLICABILITY

The present invention is useful for securing a firearm or other object from view. The present invention further allows local or remote control over locking the container such that access is denied to individuals who do not possess the proper code for unlocking, and for reporting the geographic location of the container and the open or closed status of the container to a remote monitoring station. The container, which may be a firearm holster, trigger the operation of certain safety or information-gathering devices such as cameras or microphones when the firearm is removed from the holster. The container of the invention is useful for any purpose in which it is desired to track, control access, or assess the status of a valuable or dangerous item. As an example, law enforcement organizations are able to use the container of the invention to receive a signal when a weapon has been un-holstered so that additional resources may immediately be deployed. As another example, the removal of weapon from a container of the invention may automatically trigger the operation of a body camera for remote monitoring, or for recording purposes. As another example, the container of the invention may be remotely locked in situations in which it is desired to prevent access to a firearm, such as in an occurrence in which a law enforcement officer's container, containing a weapon, has been acquired by an individual who is not authorized to possess or use the weapon.

What is claimed is:

1. A securable container for securing a handgun, comprising:

a container comprising an enclosure having an opening and an enclosed interior volume;

a retractable cover latchable into a closed state wherein said cover occludes said container opening, said cover being subjected to an opening force, wherein said retractable cover is slidingly engaged with a track formed in at least one interior surface of said enclosed interior volume;

a mechanical release for releasing said retractable cover from said closed state, allowing said retractable cover to be motivated along said track into an open state by said opening force by the retraction of said retractable cover along said track into said enclosed interior volume, wherein said open state is defined as a container state in which said retractable cover is retracted in said track so that said retractable cover no longer occludes said opening;

wherein said open state allows access to said enclosed interior volume;

wherein said track establishes a first path portion along said opening in a first direction, and establishes a second path portion along a surface of said interior volume in a second direction, the first and second track portions being connected by an arcuate path portion forming a bend in said track, said retractable cover being bendable such that it is able to transition from said first direction to said second direction along said bend as it is motivated along said track from said closed state to said open state;

and wherein said retractable cover is able to be returned to said latched closed state in which it subject to said opening force;

said securable container further comprising a barrel receiver having an upper surface and a lower surface, wherein said lower surface is subjected to an expanding upward force between said barrel receiver lower surface and an interior surface of said enclosed interior volume of said container, said expanding force oriented towards said container opening;

a latch having a latched and an unlatched state, said latch preventing motivation of said barrel receiver towards said opening when disposed in said latched state, and allowing motivation of said barrel receiver towards said opening when disposed in said unlatched state, said latch biased into said latched state by a biasing force, and said latch further comprising a striking surface;

wherein said latch is motivated against said biasing force such that it transitions to said unlatched state when said retractable cover operates on said striking surface as retractable cover is motivated into said open position by operation of said opening force, allowing said barrel receiver to be motivated toward said opening by said expanding upward force so that a handle of a handgun disposed on said barrel receiver protrudes at least partially through said opening, and wherein said motivation of said barrel receiver toward said opening is along an opposite direction as said second direction.

2. The container of claim 1, wherein said opening force is a tension force between a first end of said retractable cover and an interior surface of said enclosed interior volume.

3. The container of claim 2, wherein said tension force is provided by a tension spring attached to said first end of said retractable cover and an interior surface of said enclosed interior volume.

4. The container of claim 1, wherein said barrel receiver further comprises a barrel pin.

5. The container of claim 1, wherein said latch is further defined as a spring-loaded pawl rotatable on an axis, said spring-loaded pawl rotatably attached to an interior surface of said enclosed volume.

6. The container of claim 1, further comprising:

a controller for executing non-transitory computer executable instructions;

a computer readable media in communication with said controller, said memory containing non-transitory computer readable instructions;

an electromechanical latch in communication with said controller; and a wireless transceiver;

wherein said electromechanical latch is able to be commanded by said controller so that said electromechanical latch prevents said button from releasing said cover into an open state; and wherein said computer readable media contains non-transitory computer executable instructions for commanding said electromechanical latch to prevent said mechanical release from releasing said cover into an open state.

7. The container of claim 6, wherein said transceiver is adapted to receive commands wirelessly for commanding said controller to execute instructions for commanding said electromechanical latch to prevent said mechanical release from releasing said cover into an open state.

8. The container of claim 7, further comprising a geolocation radio frequency receiver for receiving geolocation signals and processing said signals to produce a geolocation information signal representing the geographic location of said container, said geolocation radio frequency receiver in communication with said controller; and wherein said transceiver is adapted to receive commands wirelessly for commanding said controller to execute instructions for transmitting said geolocation signal wirelessly to a remote user.

9. The container of claim 7, further comprising an external camera in wireless communication with said transceiver, and further comprising a sensor for determining when said retractable cover has been retracted into an open position; and wherein said computer executable instructions further comprise instructions for commanding said camera to an on state.

10. The container of claim 7, further comprising an external key fob comprising an RFID tag; wherein said non-transitory computer executable instructions further comprise instructions for commanding said transceiver to search for said RFID tag and to command said electromechanical latch into a latched state when said RFID tag is not found.

11. The container of claim 7, further comprising an accelerometer in communication with said controller, said accelerometer producing a signal when said container has been moved; wherein said non-transitory computer executable instructions further comprise instructions for receiving said accelerometer signal and transmitting a signal to a remote user through said transceiver that said container has been moved.

12. The container of claim 7, further comprising at least one pushbutton in electrical communication with said controller for entering a personal identification number, wherein said non-transitory computer executable instructions further comprise instructions for receiving said personal identification number entered through said at least one pushbutton and commanding said electromechanical latch to an unlocked state when an authorized personal identification code is entered.

13. The container of claim 7, further comprising a belt clip attached to an exterior surface, wherein said belt clip comprises electrical contacts for establishing an open circuit when said belt clip is clipped onto a structure, and establishing closed circuit when said belt clip is not clipped onto a structure, said electrical contacts in communication with said controller.

14. The container of claim 4, wherein said barrel pin is of sufficient length to prevent a full sliding engagement with a barrel of a handgun that has an ammunition round chambered therein.

* * * * *